US012653324B1

(12) United States Patent
Flannery et al.

(10) Patent No.: US 12,653,324 B1
(45) **Date of Patent: *Jun. 16, 2026**

(54) SWING AND SLIDE BED RAIL WITH OUTER AND INNER FRAMES

(71) Applicant: Regalo International, LLC, Burnsville, MN (US)

(72) Inventors: Mark A. Flannery, Longboat Key, FL (US); Kasey L. Pipo, Elko New Market, MN (US)

(73) Assignee: Regalo International, LLC, Burnsville, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/201,727

(22) Filed: May 24, 2023

Related U.S. Application Data

(63) Continuation of application No. 17/681,826, filed on Feb. 27, 2022, now Pat. No. 11,659,937, which is a continuation of application No. 17/109,570, filed on Dec. 2, 2020, now Pat. No. 11,259,643.

(51) Int. Cl.
*A47C 21/08* (2006.01)

(52) U.S. Cl.
CPC ..... *A47C 21/08* (2013.01)

(58) Field of Classification Search
CPC .... A47C 21/08; A61G 7/0516; A61G 7/0519; A47D 7/01; A47D 7/005
See application file for complete search history.

(56) References Cited

U.S. PATENT DOCUMENTS

| | | | | |
|---|---|---|---|---|
| 3,220,023 | A | 11/1965 | Dewey | |
| 5,596,776 | A | 1/1997 | Huang | |
| 7,908,689 | B2 | 3/2011 | Flannery | |
| 8,091,163 | B2 | 1/2012 | Flannery | |
| 8,365,324 | B2 | 2/2013 | Flannery | |
| 8,631,525 | B2 | 1/2014 | Flannery | |
| 9,125,498 | B2 | 9/2015 | Flannery | |
| 9,387,141 | B1 * | 7/2016 | Flannery | A61G 7/0507 |
| 9,687,081 | B1 | 6/2017 | Flannery | |
| 10,548,408 | B1 | 2/2020 | Flannery et al. | |
| 10,617,222 | B1 | 4/2020 | Flannery | |
| 2007/0089242 | A1 * | 4/2007 | Battiston | A47C 21/08 5/425 |

FOREIGN PATENT DOCUMENTS

| | | |
|---|---|---|
| CN | 203789548 U | 8/2014 |
| GB | 2540933 A | 2/2017 |

OTHER PUBLICATIONS https://www.youtube.com/watch?v=Y46zydpxbaQ, "Giselle Antique Metal Bed Frame Assembly & Review" (Year: 2019).*

* cited by examiner

*Primary Examiner* — Adam C Ortiz

(57) ABSTRACT

The present bed rail includes a rail portion and base portion. The rail portion swings down from an operating position and then slides into the base frame between a mattress and a mattress support to come to rest in the base frame in a stored position. The rail portion includes outer and inner frames. The outer frame is swingably and slideably engaged to the base frame. The inner frame is slideable on straight end portions of the outer frame and engages the base frame to prevent swinging and sliding of the rail portion.

6 Claims, 21 Drawing Sheets

SWING AND SLIDE BED RAIL WITH OUTER AND INNER FRAMES

This application is a continuation of U.S. patent application Ser. No. 17/681,826 filed Feb. 27, 2022 (U.S. Pat. No. 11,659,937 issued May 30, 2023) and claims the benefit thereof under 35 U.S.C. § 120, which application is a continuation of U.S. patent application Ser. No. 17/109,570 filed Dec. 2, 2020 (U.S. Pat. No. 11,259,643 issued Mar. 1, 2022) and claims the benefit thereof under 35 U.S.C. § 120, all of which applications are hereby incorporated by reference in their entireties into this application.

FIELD OF THE INVENTION

The present invention relates to a bed rail that a) swings down from an operating position at the near side of a bed and then slides into the space between a mattress and mattress support and b) is slideable out of the space between the mattress and mattress support and then swingable up to the operating position at the near side of the bed.

BACKGROUND OF THE INVENTION

Bed rails have frames. The frames are leaned upon by caregivers attending to the patient in the bed. The frames are pulled and pushed by visitors and by the patient in the bed. These actions of leaning, pulling, and pushing may have the undesirable effect of disengaging the bed rail in some fashion such that the bed rail no longer is disposed in a protective way at the near side of the bed.

SUMMARY OF THE INVENTION

A feature of the present invention is a swinging and sliding bed rail with outer and inner frames.

Another feature of the present invention is the provision in a swinging and sliding bed rail with outer and inner frames, of the bed rail having a rail portion and a base portion, where the base portion is engaged to the rail portion and adaptable for engagement with the bed between the mattress and mattress support, and where the base portion includes first and second base members spaced apart from each other.

Another feature of the present invention is the provision in a swinging and sliding bed rail with outer and inner frames, of the rail portion having a first position and a second position, where the first position is an operating position adjacent to the near side of the mattress, and where the second position is a stored position in the base portion between the mattress and the mattress support.

Another feature of the present invention is the provision in a swinging and sliding bed rail with outer and inner frames, of the rail portion being swingably engaged to the base portion.

Another feature of the present invention is the provision in a swinging and sliding bed rail with outer and inner frames, of the rail portion being slideable into and out of the base portion.

Another feature of the present invention is the provision in a swinging and sliding bed rail with outer and inner frames, of the rail portion including an outer frame and an inner frame.

Another feature of the present invention is the provision in a swinging and sliding bed rail with outer and inner frames, of the outer frame of the rail portion including a traversing member and first and second end members, where the traversing member extends between and is engaged to the first and second end members, where the first end member is swingably and slideably engaged with the first base member of the base portion, and where the second end member is swingably and slideably engaged with the second base member of the base portion.

Another feature of the present invention is the provision in a swinging and sliding bed rail with outer and inner frames, of the inner frame being slideable on the first and second end members of the outer frame and slideable to and away from the traversing member of the outer frame, and where the inner frame is engagable with and disengagable from the first and second base members of the base portion to prevent the rail portion from swinging and sliding relative to the base portion.

Another feature of the present invention is the provision in a swinging and sliding bed rail with outer and inner frames, of the outer frame including a U-shape and of the first and second end members being straight end members having respective first and second distal ends, where the first distal end is swingably engaged with the first base member, and where the second distal end is swingably engaged with the second base member.

Another feature of the present invention is the provision in a swinging and sliding bed rail with outer and inner frames, of the traversing member of the outer frame being undulating and of the first and second end members being straight end members having respective first and second distal ends, where the first distal end is swingably engaged with the first base member, and where the second distal end is swingably engaged with the second base member.

Another feature of the present invention is the provision in a swinging and sliding bed rail with outer and inner frames, of the inner frame includes an uppermost traversing member, the uppermost traversing member of the inner frame being slideably engaged to the first and second end members of the outer frame, and where the uppermost traversing member of the inner frame is slideable to and away from the traversing member of the outer frame.

Another feature of the present invention is the provision in a swinging and sliding bed rail with outer and inner frames, of the inner frame including a lowermost traversing member, where the lowermost traversing member of the inner frame is slideably engaged to the first and second end members of the outer frame, where the lowermost traversing member of the inner frame is slideable to and away from the first and second base members when the rail portion is in the operating position.

Another feature of the present invention is the provision in a swinging and sliding bed rail with outer and inner frames, of the inner frame including an uppermost traversing member, where the uppermost traversing member of the inner frame is slideably engaged to the first and second end members of the outer frame and slideable to and away from the traversing member of the outer frame, where the traversing member of the outer frame includes a first portion, a second portion, and a third portion, where the first and third portions of the traversing member of the outer frame are spaced apart from the uppermost traversing member of the inner frame by a first distance, where the third portion of the traversing member of the outer frame is spaced apart from the uppermost traversing member of the inner frame by a second distance, and where the first distance is greater than the second distance.

Another feature of the present invention is the provision in a swinging and sliding bed rail with outer and inner frames, of the traversing member of the outer frame including a first straight portion having an axis, a second straight portion having an axis, and a third straight portion having an axis, where the axis of the first and third straight portions of the outer frame are co-axial, and where the axis of the second straight portion is offset from the axis of the first and third straight portions.

Another feature of the present invention is the provision in a swinging and sliding bed rail with outer and inner frames, of the traversing member of the outer frame further including fourth and fifth portions, where the fourth portion is disposed between the first and second straight portions, where the fifth section is disposed between the second and third straight portions, and where each of the fourth and fifth portions are oblique relative to the straight second portion.

Another feature of the present invention is the provision in a swinging and sliding bed rail with outer and inner frames, of the inner frame including an uppermost traversing member, a lowermost traversing member, and a set of support members extending to and between the uppermost and lowermost traversing members, where the support members are spaced apart from each other and further are spaced from the first and second end members of the outer frame, where the uppermost traversing member of the inner frame is adjacent to the traversing member of the outer frame, where the lowermost traversing member of the inner frame includes first and second ends, where the first end of the lowermost traversing member of the inner frame is adjacent to the first end member of the outer frame, and where the second end of the lowermost traversing member of the inner frame is adjacent to the second end member of the outer frame.

Another feature of the present invention is the provision in a swinging and sliding bed rail with outer and inner frames, of the inner frame including an uppermost traversing member, a lowermost traversing member, and a set of support members extending to and between the uppermost and lowermost traversing member, where the support members are spaced apart from each other and further are spaced from the first and second end members of the outer frame, where the uppermost traversing member of the inner frame includes first and second sections that are engagable to and disengagable from each other at a first junction that is disposed intermediate of ends of the uppermost traversing member of the inner frame, where the lowermost traversing member of the inner frame includes first and second sections that are engagable to and disengagable from each other at a second junction that is disposed intermediate of ends of the lowermost traversing member of the inner frame.

Another feature of the present invention is the provision in a swinging and sliding bed rail with outer and inner frames, of the traversing member of the outer frame including a first frame section and a second frame section, where the first and second frame sections are engagable to and disengagable from each other at a third junction that is disposed intermediate of ends of the traversing member of the outer frame such that the rail portion includes a right hand unit and a left hand unit that are engagable to and disengagable from each other.

Another feature of the present invention is the provision in a swinging and sliding bed rail with outer and inner frames, of the first, second, and third junctions being aligned vertically with each other when the rail portion is in the operating position.

Another feature of the present invention is the provision in a swinging and sliding bed rail with outer and inner frames, of the first, second, and third junctions being spaced equidistance from the first and second end portions of the outer frame member.

Another feature of the present invention is the provision in a swinging and sliding bed rail with outer and inner frames, of a method for operating a bed rail, where the bed rail includes a rail portion and a base portion, where the rail portion is swingably engaged to the base portion, where the rail portion is slideably engaged to the base portion, where the rail portion includes an outer frame and an inner frame, and where the inner frame is engagable to and disengagable from the base portion.

Another feature of the present invention is the provision in the method for operating a bed rail, of the steps of: a) raising a bed rail inner frame relative to a bed rail outer frame, where the step of raising the bed rail inner frame relative to the bed rail outer frame includes the step of disengaging the inner frame from the base portion; then b) swinging the rail portion relative to the base portion; and then c) sliding the rail portion into the base portion.

An advantage of the present invention is a safe bed rail. For example, in the operating position, the outer frame of the bed rail may be leaned upon and pulled and pushed and, at the same time, the rail portion of the bed rail remains in its operating position without swinging from the operating position or otherwise being disengaged therefrom.

Another advantage of the present invention is that the outer frame is not utilized for disengaging the rail portion from the operating position.

Another advantage of the present invention is that the inner frame is utilized for disengaging the rail portion from the operating position.

Another advantage of the present invention is that the unlocking, swinging, and sliding steps may be performed with one hand, where unlocking is performed by raising the inner frame relative to the outer frame with one hand, where swinging is performed by pulling the inner frame and thus the rail portion as a whole toward oneself with the same hand after the unlocking step, and where the sliding step is performed by pushing the inner frame and thus the rail portion as a whole into the base portion.

Another advantage of the present invention is that the inner frame is breakable down into a right hand portion and a left hand portion for transport and storage.

Another advantage of the present invention is that the outer frame is breakable down into a right hand portion and a left hand portion for transport and storage.

Another advantage of the present invention is that the rail portion as a whole is breakable down into a right hand portion and a left hand portion for transport and storage.

Another advantage of the present invention is that the base portion is breakable down into a right hand portion and a left hand portion for transport and storage.

Another advantage of the present invention is that the present bed rail is inexpensive to manufacture.

Another advantage of the present invention is that the present bed rail is easy to assemble and easy to disassemble.

DESCRIPTION

Figure 1:
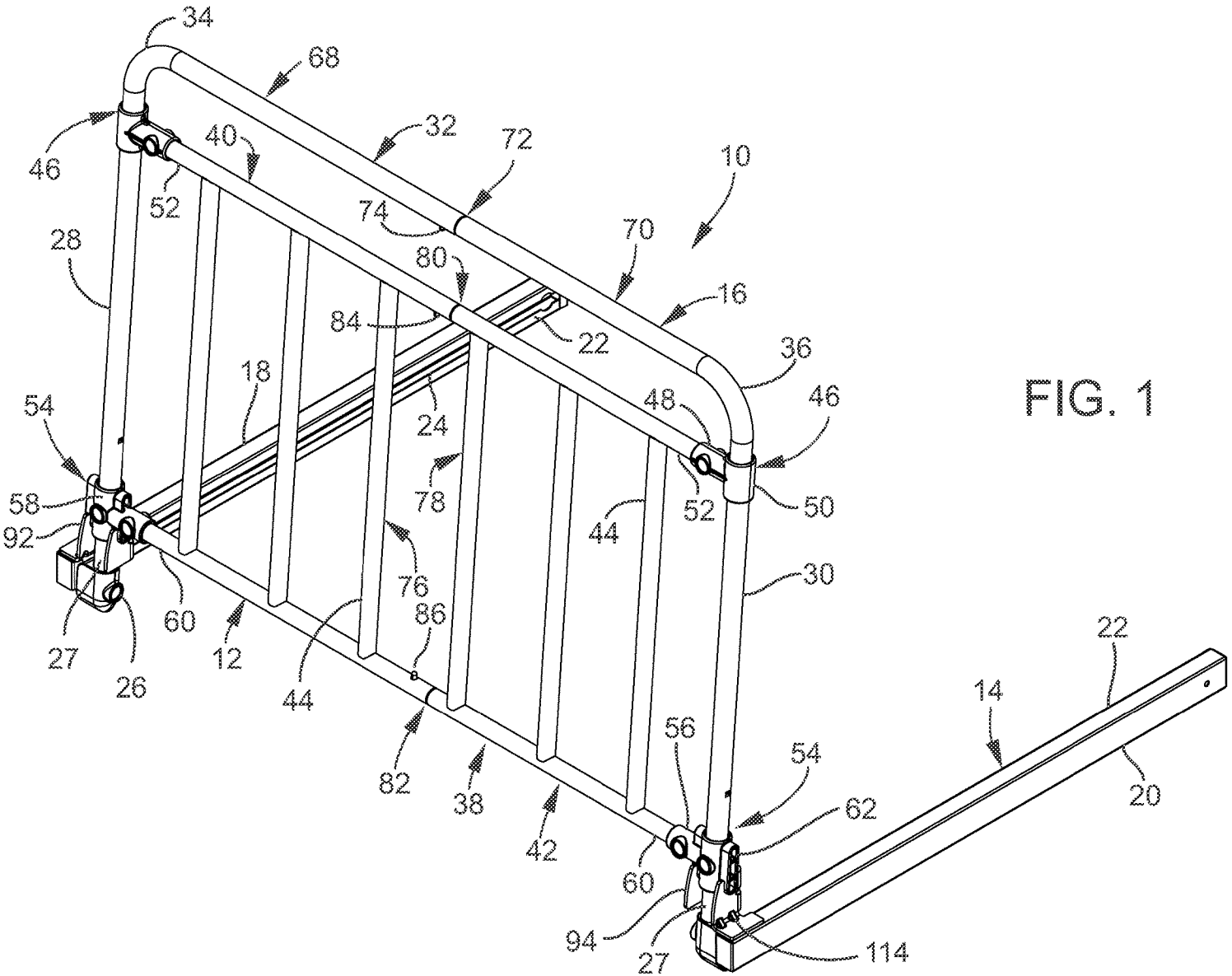
FIG. 1 is a perspective view of a first embodiment of the present swing and slide bed rail in a locked and operating position.

As shown in FIG. 1, a first embodiment of the present swing and slide bed rail is indicated by the reference number 10. Bed rail 10 includes a rail portion 12 and a base portion 14. Base portion 14 is engaged between a mattress 15 (shown in FIG. 5A) and mattress support 17 (shown in FIG. 5A) such as a box spring. Rail portion 12 in FIG. 1 is shown in a locked and operating position. From the locked and operating position of FIG. 1, the rail portion 12 may be lifted up to an unlocked position shown in FIG. 2. Then the rail portion 12 may be swung down to the position shown in FIG. 6A, then further swung down to the position shown in FIG. 6B, then slid partially into the base portion 14 as shown in FIG. 6C, and then slid fully into the base portion 14 as shown in FIG. 6D.

Figure 8B:
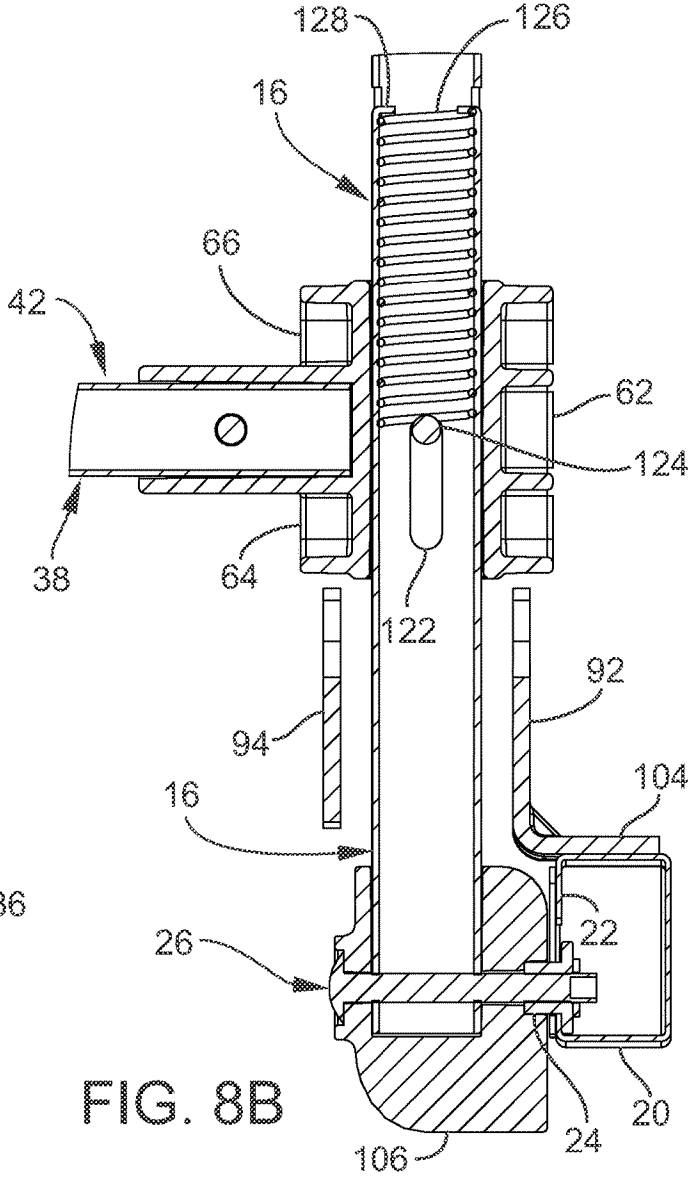
FIG. 8B is a section view of a portion of the swing and slide bed rail of FIG. 2, showing the swing and slide bed rail in the unlocked position of FIGS. 2, 4 and 5B.
Figure 8A:
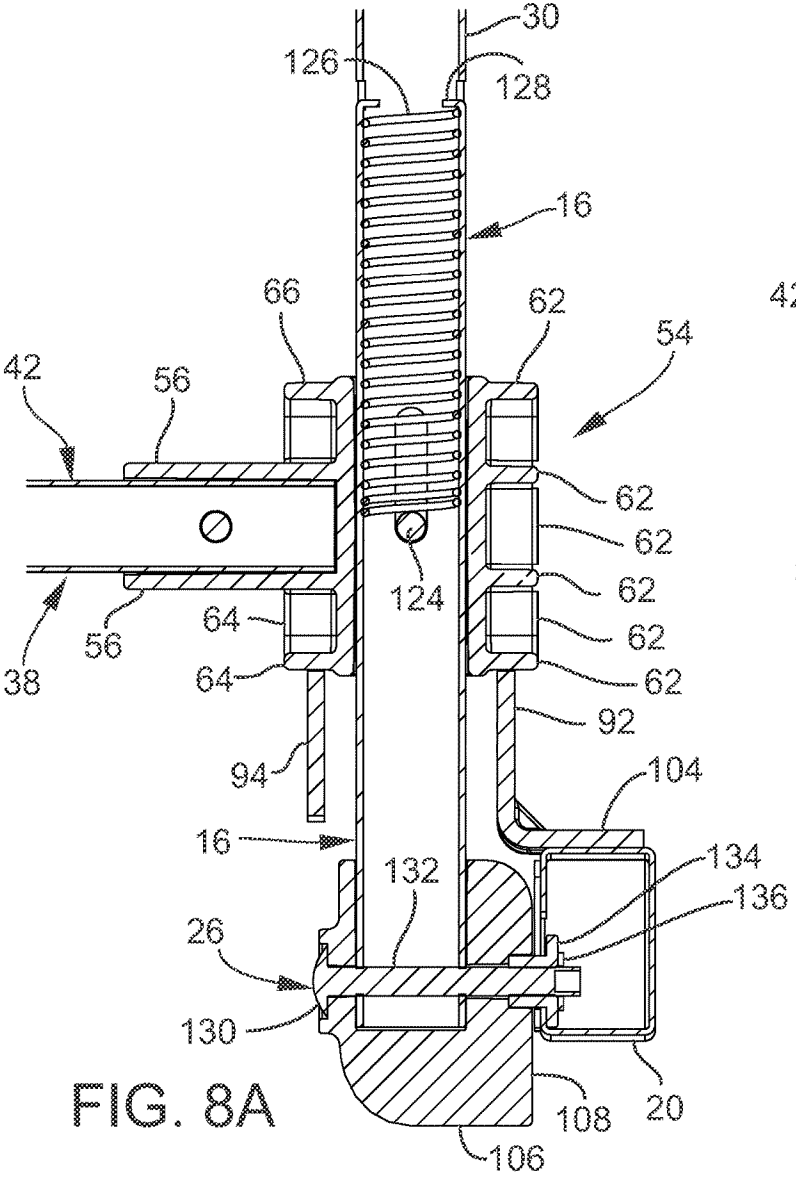
FIG. 8A is a section view of a portion of the swing and slide bed rail of FIG. 1, showing the swing and slide bed rail in the locked and operating position of FIG. 1.

Rail portion 12 includes a U-shaped tubular frame 16 or outer frame 16. U-shaped tubular frame 16 is pivotally engaged to the base portion 14. Base portion 14 includes first and second base members 18, 20. Each of the first and second base members 18, 20 includes an inner side 22 having a longitudinal slot 24 formed therein. As shown in FIGS. 1, 8A and 8B, a pin assembly 26 pivotally and slidingly engages each of the lower ends 27 of first and second straight end members 28, 30 of the U-shaped tubular frame 16 to the first and second base members 18, 20. Pin assembly 26 further engages longitudinal slot 24.

As shown in FIG. 1, U-shaped tubular frame 16 includes the first and second straight end support members 28, 30 and further includes a traversing horizontal support member 32. U-shaped tubular frame 16 also includes a first curved transition portion 34 and a second curved transition portion 36 between the straight end members 28, 30, respectively, and the traversing member 32.

Rail portion 12 includes a sub-unit 38 or inner frame 38. Sub-unit 38 slides to and away from traversing member 32. Sub-unit 38 slides to and away from lower ends 27 of the of the first and second straight end members 28, 30. Sub-unit 38 includes a pair of upper and lower traversing horizontal tubular support members 40, 42. Traversing members 40, 42 run parallel to traversing member 32. Sub-unit 38 further includes a set of vertically extending tubular support members 44 running to and between the traversing members 40, 42. Support members 44 are rigidly engaged, such as by welding, to traversing members 40, 42. Vertically extending support members 44 extend parallel to the straight end support members 28, 30 and are coplanar therewith.

Rail portion 12 includes a pair of upper T-joints 46 that slidingly engage the sub-unit 38 to the straight end members 28, 30. T-joint 46 includes a horizontally extending tube 48 and a vertically extending tube 50. Tubes 48, 50 are rigidly engaged to each other such as by welding. Vertically extending tube 50 includes an inner diameter about equal to or slightly greater than the outside diameter of the straight end members 28, 30 such that tubes 50 slide on the straight end members 28, 30 with some friction albeit minimal friction. If desired, sliding can be maximized by forming the inner diameters of tubes 50 significantly greater than the outside diameters of straight end members 28, 30. Tube 48 is a female receptor for outer ends 52 of upper or uppermost traversing member 40 of sub-unit 38. Outer end 52 may be rigidly engaged in tube 48 by a pin connector such as a rivet.

Rail portion 12 further includes a pair of lower T-joints 54 that slidingly engage the sub-unit 38 to the straight end members 28, 30. T-joint 54 includes a horizontally extending tube 56 and a vertically extending tube 58. Tubes 56, 58 are rigidly engaged to each other such as by welding. Vertically extending tube 58 includes an inner diameter about equal to or slightly greater than the outside diameter of the straight end members 28, 30 such tubes 58 slide on the straight end members 28, 30 with some friction albeit minimal friction. If desired, sliding can be maximized by forming the inner diameters of tubes 58 significantly greater than the outside diameters of straight end members 28, 30. Tube 56 is a female receptor for outer ends 60 of lower or lowermost traversing member 42 of sub-unit 38. Outer end 60 may be rigidly engaged in tube 56 by a pin connector such as a rivet.

Lower T-joint 54 further includes an outer oblong insert 62 and an inner oblong insert 64. Outer oblong insert 62 is integral and one-piece with the vertical tube 58 of lower T-joint 54 and extends vertically. Inner oblong insert 64 is integral and one-piece with the vertical tube 58 of lower T-joint 54 and is further integral and one-piece with the horizontal tube 56 of the lower T-joint 54. An upper and inner insert 66 is an insert only in an aesthetic sense and is inserted into no receptor, yet insert 66 is functional in that it aids the user by telling the user the position of its diametrically opposite insert 64. Upper and inner insert 66 extends diametrically opposite of inner and lower insert 64. Upper and inner insert 66 extends from the upper side of horizontal tube 56 and is one-piece and integral with tube 56. Upper and inner insert 66 is also engaged to and extends integrally from the inner side of vertical tube 58.

U-shaped tubular frame 16 includes two units, a first L-shaped unit 68 and a second L-shaped unit 70. First L-shaped unit 68 includes a half-section of traversing member 32, transition portion 34, and straight end member 28. Second L-shaped unit 70 includes a half-section of traversing member 32, transition portion 36, and straight end member 30. The L-shaped units 68, 70 removably engage each other at a junction 72, where one of the half-sections of traversing member 32 includes a male connection and where the other of the half sections of traversing member 32 includes a female connection. Such connections are locked together with a spring biased button 74 that includes a spring base disposed inside of the half-section on L-shaped unit 68, and where the button 74 extends through aligned holes in the male and female connectors. The male and female connectors may be separated by depressing button 74 until the male and female connectors are slideable apart.

Figure 9:
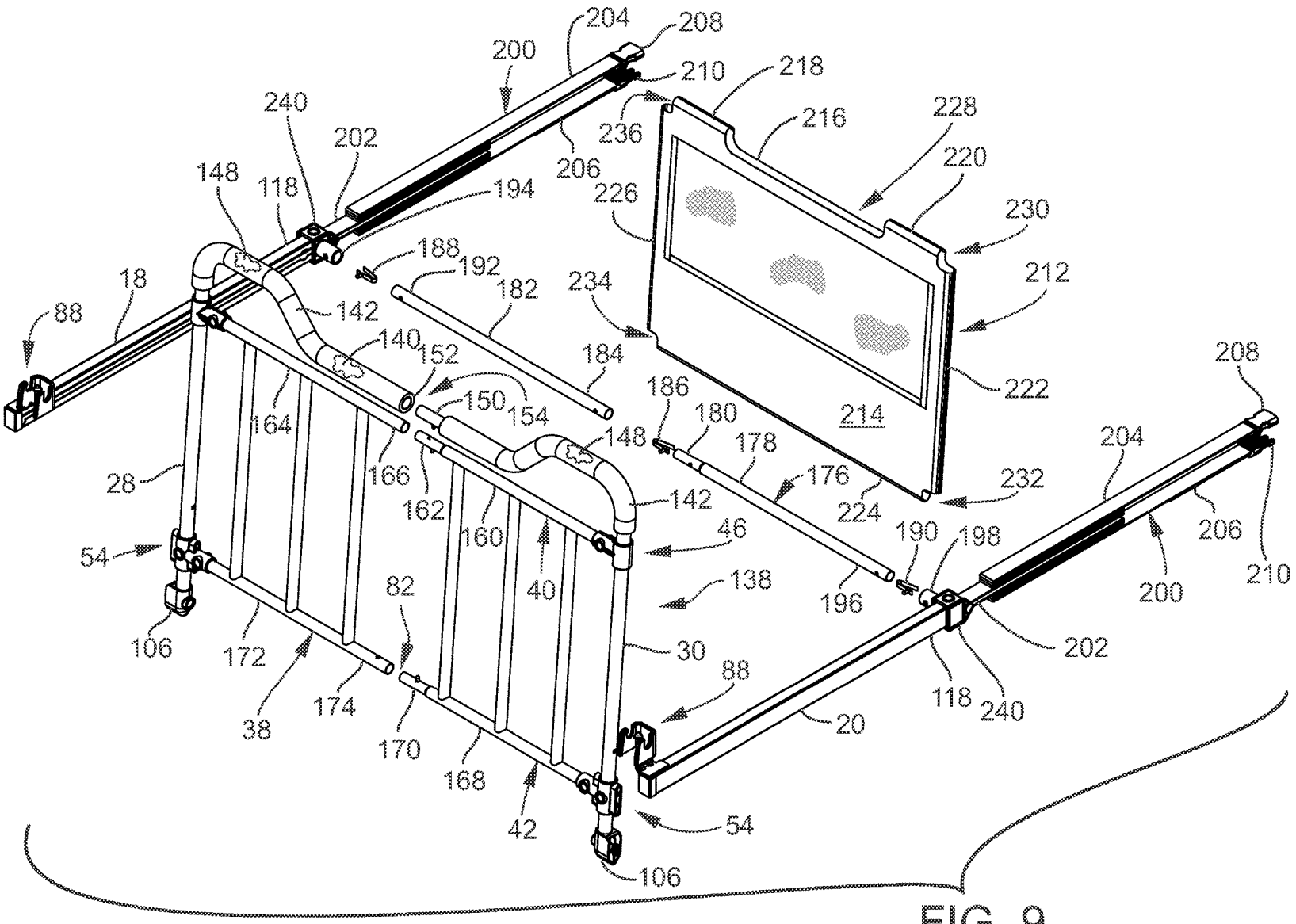
FIG. 9 is an exploded perspective view of a second embodiment of the present swing and slide bed rail.

Sub-unit 38 includes first and second units 76, 78. The units 76, 78 are removably engaged at an upper junction 80 and a lower junction 82. As shown in FIG. 9, uppermost traversing member 40 includes two sections, where one section 164 includes a female member 166, where the other section 160 includes a male member 162, and where a depressable spring biased button 84 extends through aligned button openings of the male and female members. Depressing button 84 permits such sections 160, 164 to be slid apart and disengaged from each other. Lowermost traversing member 42 includes two sections, where one section 172 includes a female member 174, where the other section 168 includes a male member 170, and where a depressable spring biased button 86 extends through aligned openings of the male and female members 162, 166. Depressing button 86 permits such sections 160, 164 to be slid apart and disengaged from each other. First unit 76 includes the left section 164 of uppermost traversing section 40, the left section 172 of lowermost traversing member 42, the three left vertical support members 44, the left upper T-joint 46, and the left lower T-joint 54. Second unit 78 includes the right section 160 of uppermost traversing member 40, the right section 168 of lowermost traversing member 42, the right three vertical support members 44, the right upper T-joint 46, and the right lower T-joint 54.

Junctions 72, 80, and 82 may be engagable or disengagable at the same time such that bed rail 10 may be broken down into two units, where a first unit is a) one-half of the rail portion 12 and b) base member 18 and where a second unit is a) one-half of the rail portion 12 and b) base member 20. Junctions 72, 80, 82 are aligned vertically with each other.

Figure 2:
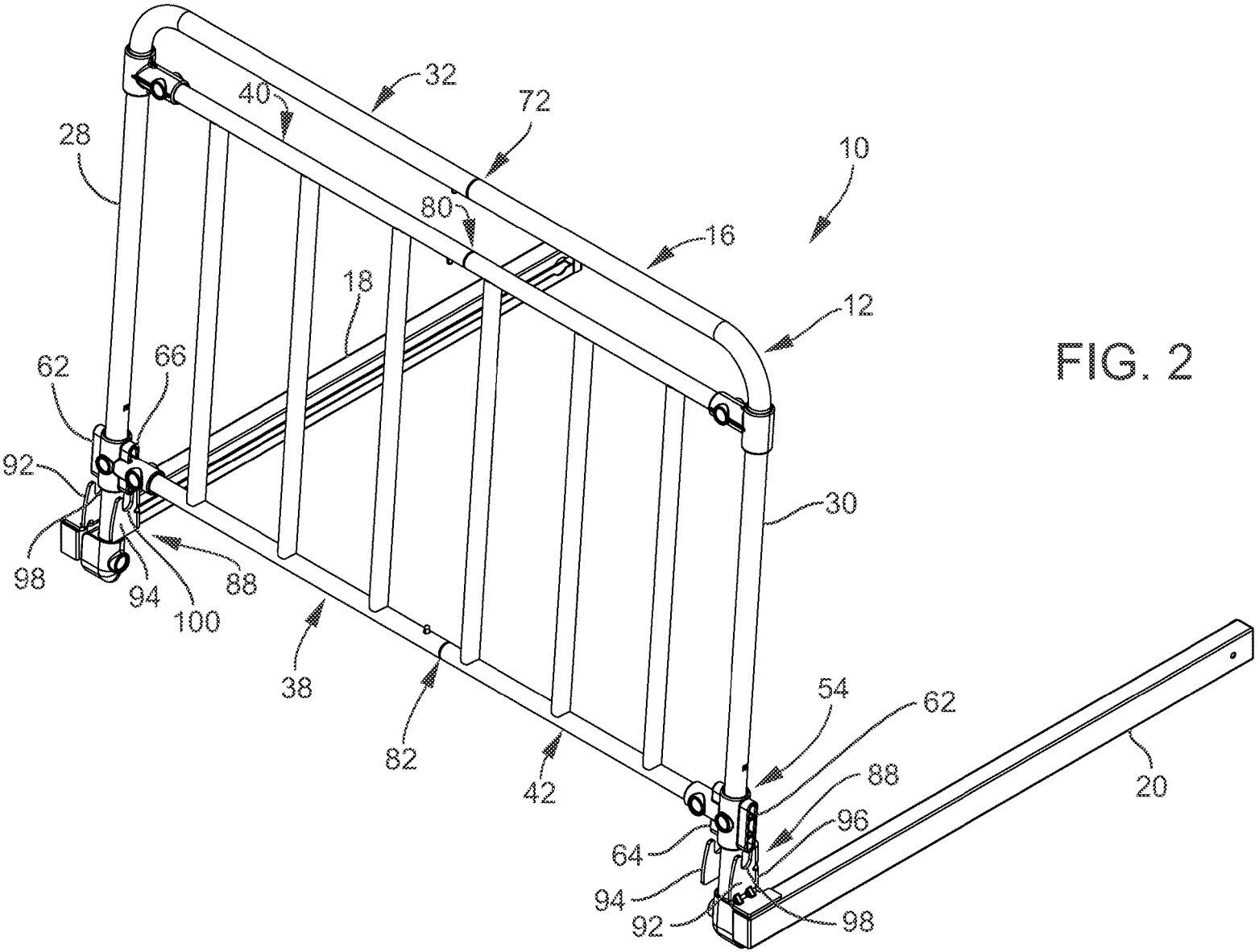
FIG. 2 is a perspective view of the swing and slide bed rail of FIG. 1 lifted up from the locked position of FIG. 1 to an unlocked position.

As shown in FIG. 2, each of the base members 18 and 20 includes a seat apparatus 88 for engaging a respective lower T-joint 54. Each of the seat apparatus 88 includes a U-shaped structure 90. U-shaped structure 90 includes three walls 92, 94, and 96. Wall 92 is an outer wall and is rigidly engaged, such as by welding, to its respective base member 18, 20. Wall 94 is an inner wall and is spaced from and lies parallel to outer wall 92. Wall 96 is a connecting wall that connects outer wall 92 to inner wall 94. Wall 96 lies at a right angle to the axis of its respective base member 18 or 20. Outer and inner walls 92, 94 lie in respective planes, each of which is parallel to the axis of its respective base member 18 or 20. Outer wall 92 includes a U-shaped seat 98 that engages oblong outer insert 62. Inner wall 94 includes a U-shaped seat 100 that engages inner insert 64. When the inserts 62, 64 are engaged in the seats 98, 100 such that each of the lower T-joints 54 are engaged in the seat apparatus 88, the rail portion 12 is in a locked sturdy operating position that confronts the near side of the mattress 15 and projects above the sleeping surface of the mattress 15. Such engagement is at least a four point engagement. Such engagement may be a six point engagement when the connecting or rear wall 96 is manufactured to abut the vertical tube of the lower T-joint 54.

Connecting walls 96 act as a counter members that are disposed against the near side of mattress 15 when the distal ends of the base members 18, 20 are engaged to straps that in turn are engaged to counter member pieces that lie against the far sides of the mattress support 17 and mattress 15 such that, when the bed rail 10 is disposed between the upper surface of the mattress support 17 and the lower surface of the mattress 15, the bed rail 10 hugs tightly the near and far sides of the mattress support 17 and the mattress 15 whether the bed rail 10 is in an operating mode where the rail portion 12 confronts the near side of the mattress 15 or whether the bed rail 10 is in a stored away mode where the rail portion 12 is tucked away between the mattress 15 and mattress support 17.

Figure 3:
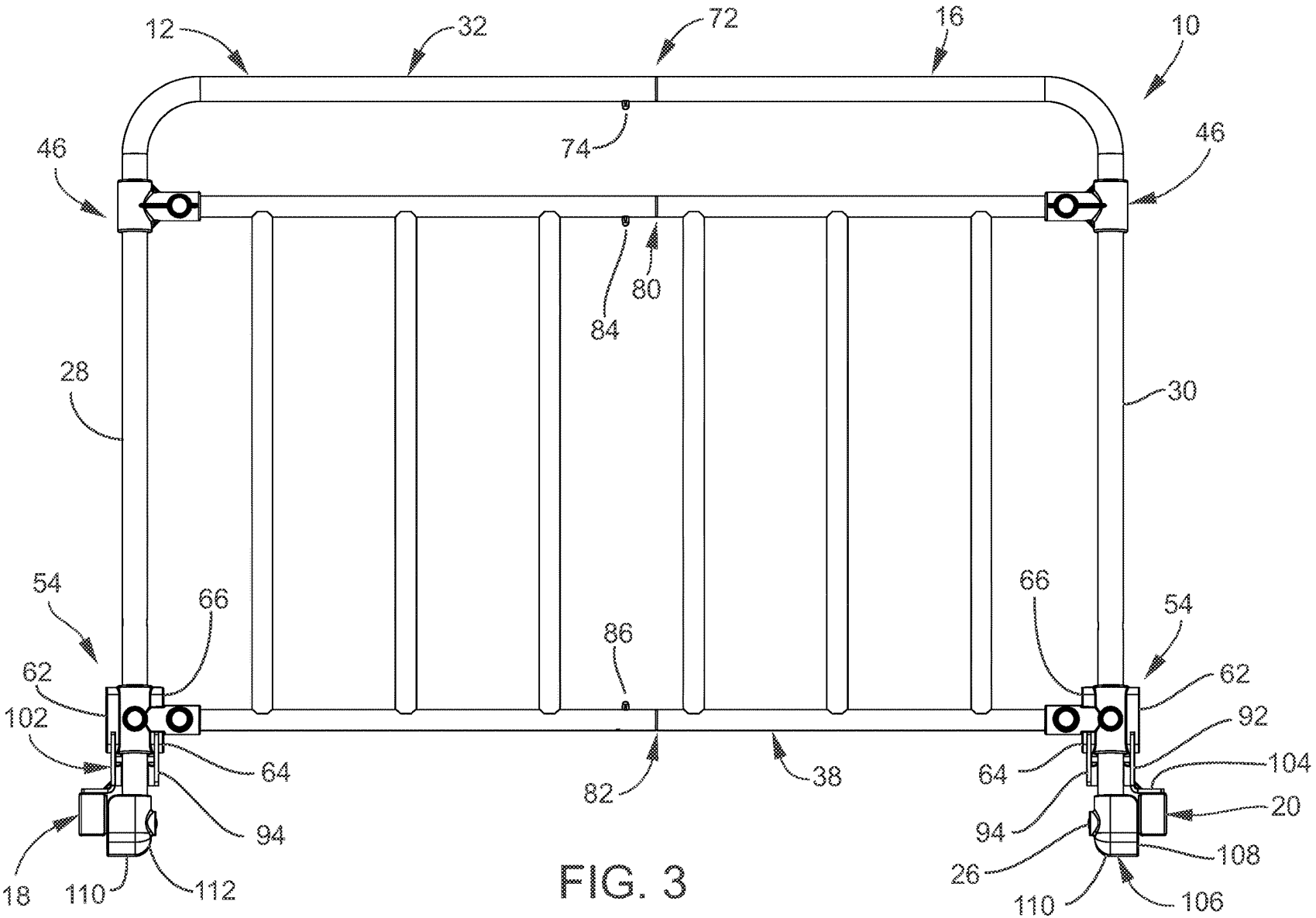
FIG. 3 is a front elevation view of the swing and slide bed rail of FIG. 1 in the locked and operating position of FIG. 1.

FIG. 3 shows the inserts 62, 64 engaging their respective seats 98, 100 of their respective outer and inner walls 92, 94.

FIG. 3 shows that outer wall 92 is an integral portion of a right angle piece 102 having a floor 104 and the outer wall 92. Floor 104 is rigidly engaged, such as by welding, to the top of its respective base 18 or 20. Each of the base members 18, 20 have a top, a bottom, an inner side, and an outer side. Inner side is inner side 22.

FIG. 3 shows that the U-shaped frame 16 includes, at each of its lower ends 27, a block 106, such as a plastic block 106. Block 106 engages pin assembly 26. Block 106 further engages lower end 27 of the straight end members 28, 30.

Block 106 includes an outer face 108 that rides against the inner side 22 of its respective base member 18 or 20 to minimize any play or wobble between the U-shaped tubular frame 16 and the base members 18, 20. Block 106 includes a curved under face or lower face 110 such that, when block 106 is pushed between the mattress 15 and the mattress support 17, such curved under face or lower face parts or spreads apart the mattress 15 and the mattress support 17. This curved under face 110 leads into a curved side face 112 that also helps to spread apart the mattress 15 and mattress support 17.

FIG. 3 shows that the lowermost portion of block 106 is disposed at an altitude lower than the lower face of the bottom of the base support members 18, 20. The lower faces of the base support members 18, 20 define a plane and the lowermost portion of block 106 is spaced from and below such plane.

Figure 4:
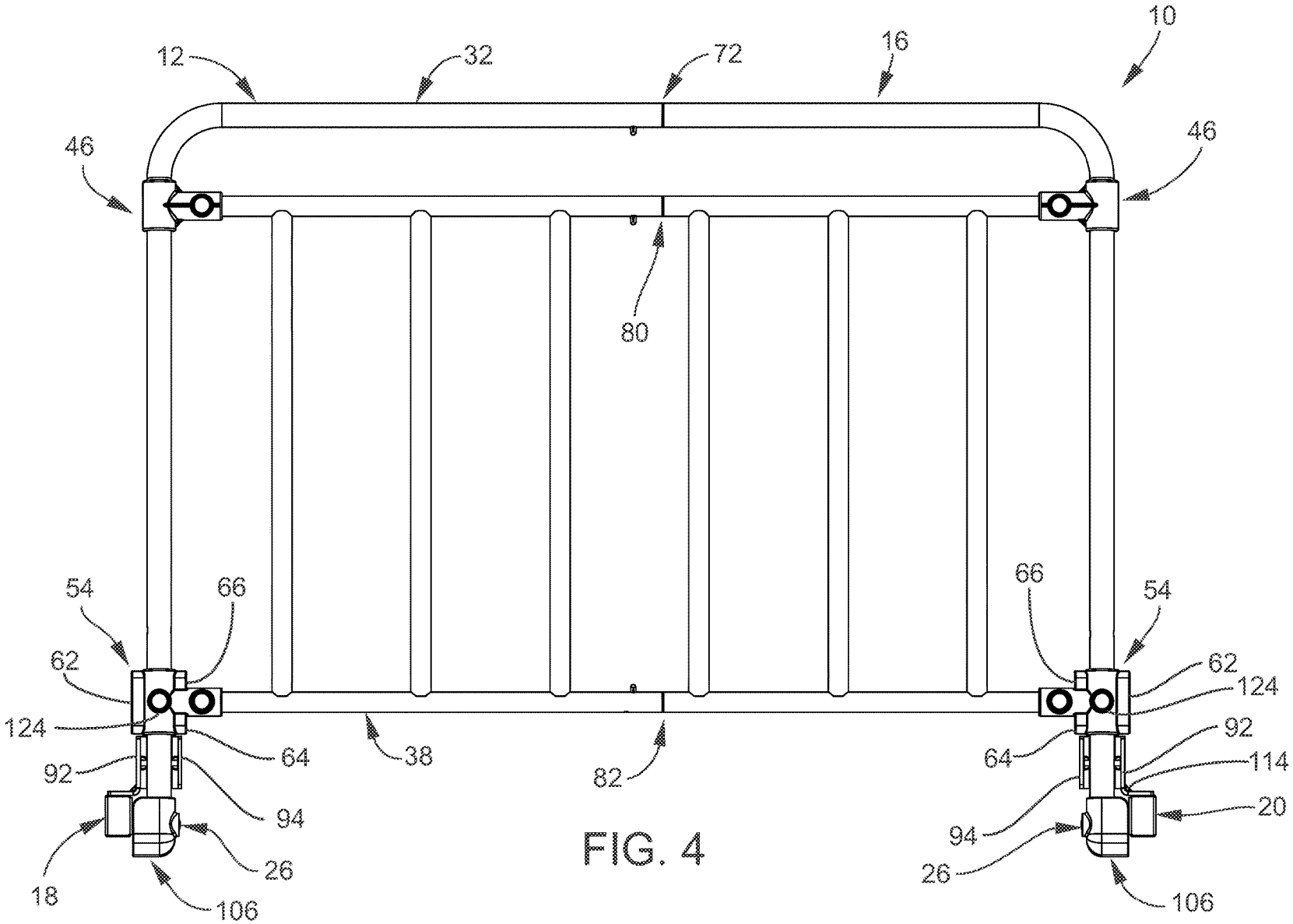
FIG. 4 is a front elevation view of the swing and slide bed rail of FIG. 2 in the position of FIG. 2 where the swing and slide bed rail has been lifted up from the locked position of FIGS. 1 and 3.

FIG. 4 shows that inserts 62, 64 have been disengaged from their respective seats 98, 100 of the outer and inner walls 92, 94 such that the rail portion 12 may begin to pivot about pin assemblies 26. Alternatively, FIG. 4 shows that the rail portion 12 has been pivoted to a location where the inserts 62, 64 may be dropped down into their respective seats 98, 100 of their respective walls 92, 94.

FIG. 4 shows that the outermost portion of insert 62 defines a plane with the outer face 108 of block 106 such that each of outermost portion of insert 62 and the outer face 108 of block 106 ride against the inner side 22 of base support members 18, 20. The width of outer insert 62 is greater than the width of longitudinal slot 24 such that insert 62 is not caught in longitudinal slot 24. If desired, insert 62 may project slightly beyond a plane defined by outer face 108 and insert 62 may be narrowed such that insert 62 may ride in, or ride partially in longitudinal slot 24 when the rail portion 12 is slid to its stored position from, for example, the position shown in FIG. 6B to the position shown in FIG. 6D.

FIG. 4 shows that the lateral width of the block 106, which width includes the innermost head of the pin assembly 26, is about the lateral width of lower T-joint 54 such that dependence upon the lower T-joint 54 to further spread apart the mattress 15 and mattress support 17 is minimized.

FIG. 4 further shows braces 114 formed in the seating apparatus 88. Two braces 114, such as formed by welding, strengthen the connection between inner wall 94 and rear wall 96. Two braces 114 strengthen the connection between rear wall 96 and outer wall 92. As shown in FIG. 1, two braces 114 strengthen the connection between outer wall 92 and floor 104.

Figure 5B:
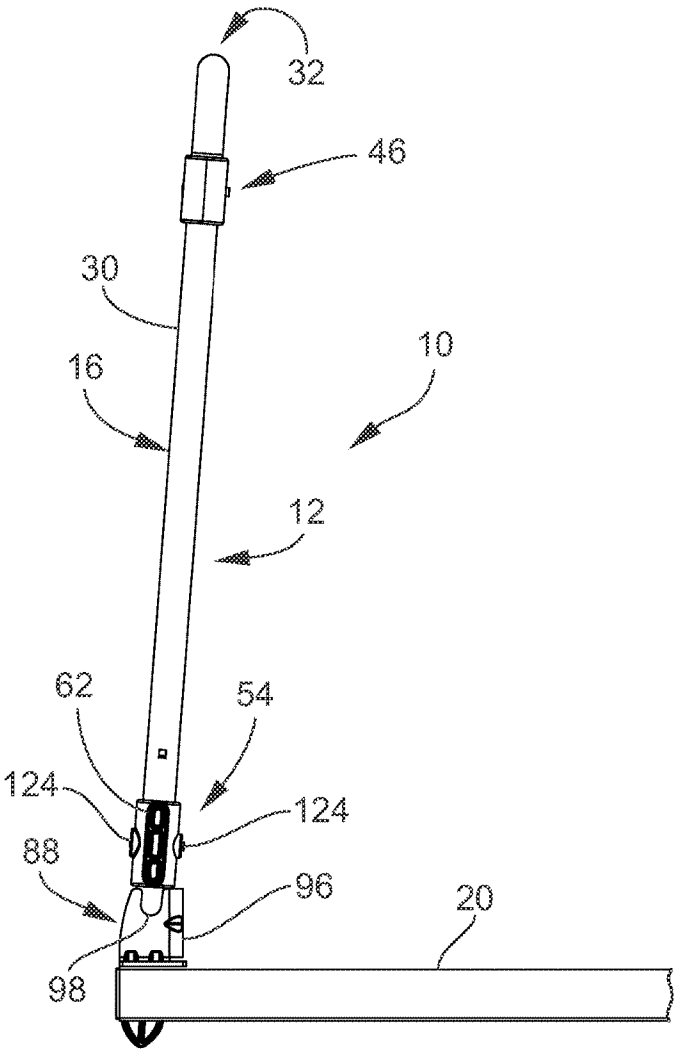
FIG. 5B is a side partial view of the swing and slide bed rail of FIGS. 2 and 4 where the swing and slide bed rail has been lifted up from the locked position of FIGS. 1, 3, and 5A.
Figure 5A:
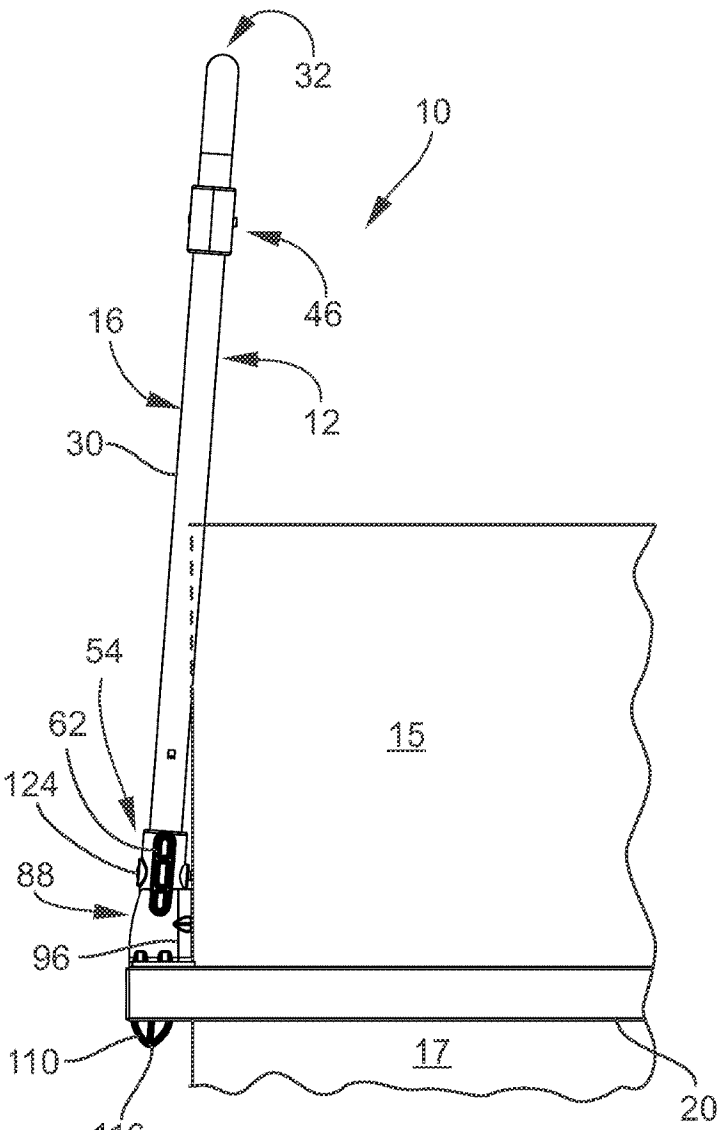
FIG. 5A is a side partial view of the swing and slide bed rail of FIG. 1 in the locked and operating position of FIG. 1 and further shows a portion of a mattress and a portion of a mattress support.

FIGS. 5A and 5B show that the curved under face 110 includes an apex 116 that spreads the mattress 15 and mattress support 17 apart as the rail portion 12 is slid between the mattress 15 and mattress support 17.

FIGS. 5A and 5B show that the rail portion 12 defines a plane and that, when the rail portion 12 is in the operating position shown in FIG. 5A, such plane is at an acute angle relative to an axis of base support members 18, 20. In other words, the axis of the base support members 18, 20 define a first plane, the rail portion 12 defines a second plane, and the first and second planes extend at an acute angle to each other such that the rail portion 12 may close off a gap that may otherwise form between the near side of the mattress 15 and rail portion 12. This acute angle relationship is found when the rail portion 12 is engaged in the seat apparatus 88 and when the rail portion 12 is in the operating position. This acute angle relationship is provided by the acute angle orientation of the inner and outer seats 98, 100.

Figure 6A:
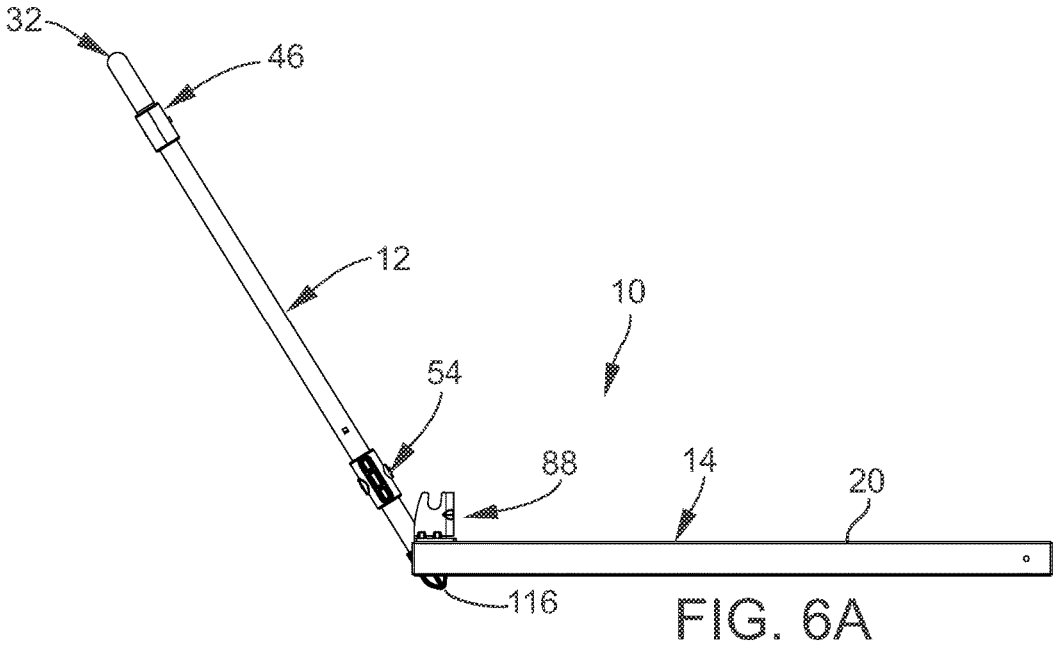
FIG. 6A is a side view of the swing and slide bed rail of FIG. 1 being swung down from the position shown in FIGS. 2, 4, and 5B where the swing and slide bed rail has been lifted up from the locked position of FIGS. 1, 3, and 5A.
Figure 6B:
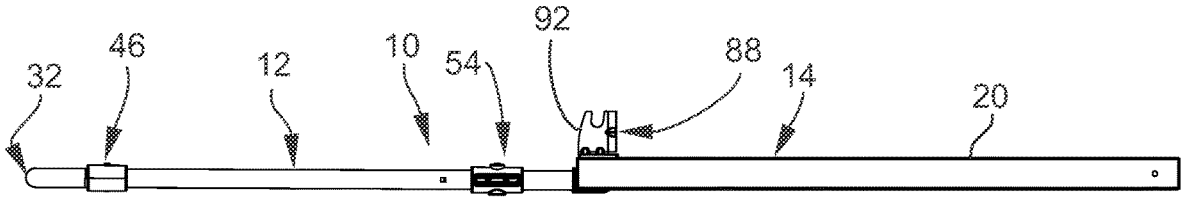
FIG. 6B is a side view of the swing and slide bed rail of FIG. 1 having been swung down from the position shown in FIG. 6A.
Figure 6C:
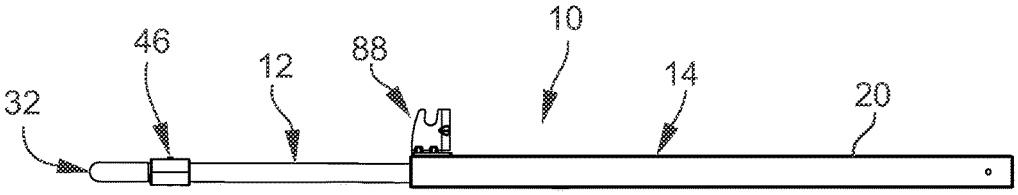
FIG. 6C is a side view of the swing and slide bed rail of FIG. 1 having been slid partially into the base of the swing and slide bed rail of FIG. 1.
Figure 6D:
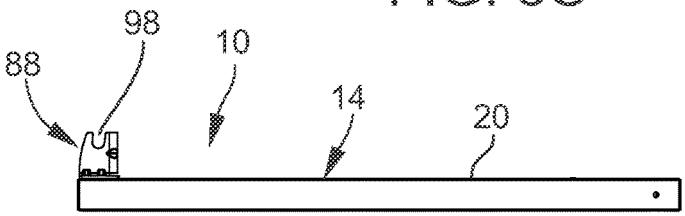
FIG. 6D is a side view of the swing and slide bed rail of FIG. 1 having been slid fully into the base of the swing and slide bed rail of FIG. 1.

FIGS. 5A, 5B, 6A, 6B, 6C, and 6D shows the sequential steps for taking the rail portion 12 down from the operating position. FIG. 5A shows the rail portion 12 engaged with the seat apparatus 88 and in the operating position confronting the near side of a mattress 15. FIG. 5B shows the rail portion 12 just after disengagement with the seat apparatus 88, having been pulled up from the seat apparatus 88. FIG. 6A shows the rail portion 12 having been pivoted and swung forwardly and away from the near side of the mattress 15, from an acute angle relationship with the base members 18, 20, through a right angle relationship with the base members 18, 20, and into an obtuse angle relationship with the base members 18, 20. FIG. 6B shows the rail portion 12 in a common plane with the base members 18, 20, but not yet sliding into the base members 18, 20. FIG. 6C shows the rail portion 12 being slid into the base members 18, 20. FIG. 6D shows the rail portion 12 having been slid completely into the base members 18, 20 where the outermost surface of the traversing member 32 of the outer frame 16 is at or within the outermost proximal ends of the base members 18, 20.

Figure 7A:
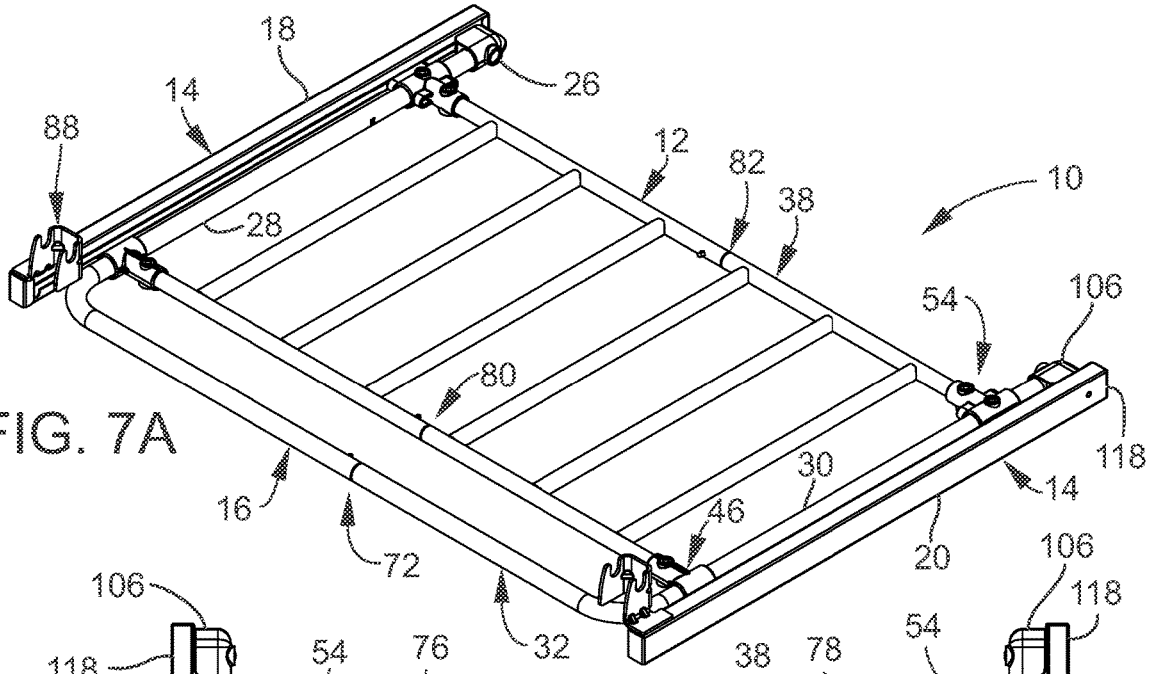
FIG. 7A is a perspective view of the swing and slide bed rail of FIG. 1 having been slid fully into the base of the swing and slide bed rail of FIG. 1.
Figure 7B:
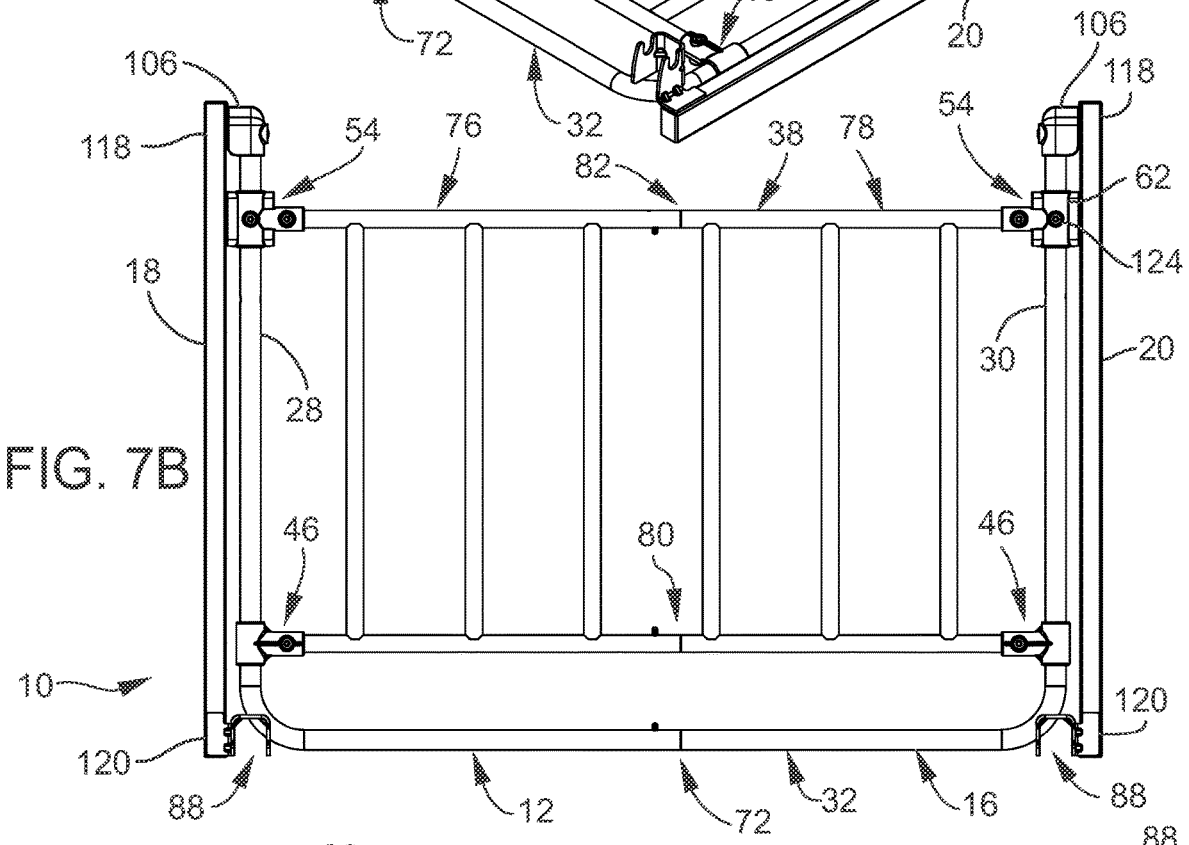
FIG. 7B is a top plan view of the swing and slide bed rail of FIG. 1 having been slid fully into the base of the swing and slide bed rail of FIG. 1.
Figure 7C:
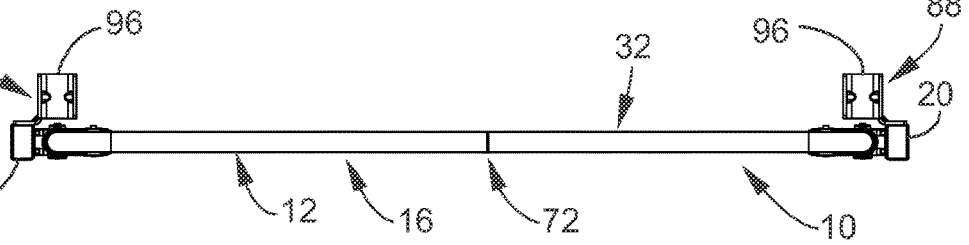
FIG. 7C is a front view of the swing and slide bed rail of FIG. 1 having been slid fully into the base of the swing and slide bed rail of FIG. 1.

FIG. 7A shows a perspective view of the rail portion 12 in the stored position in the base 14. FIG. 7B shows a top plan view of the rail portion 12 in the stored position in the base 14. FIG. 7C shows a front view of the rail portion 12 in the stored position in the base 14. Base support members 18, 20 make up at least a portion of base 14. Another portion of base 14 may be straps that engage the distal ends 118 of the base support members 18, 20 of the base portion 14 to the far sides of the mattress 15 and mattress support 17.

FIG. 7A shows the U-shaped structure of the seat apparatus 88, where the U-shape is formed by outer wall 92, inner wall 94, and connecting or rear wall 96. FIGS. 7A, 7B, and 7C show that the base portion 14 and the rail portion 12 define a plane and lie in a common plane, with the exception of seat apparatus 88 that extends upwardly from such defined and common plane. FIG. 7B shows that each of the outer inserts 62 confronts and is adjacent to the inner side 22 of the respective base support members 18, 20 when the rail portion 12 is in the base portion 14. FIG. 7C shows that the bottom edges of the connecting or real wall 96 lie above and are spaced from a plane defined by the top of the rail portion 12 or an axis of the rail portion 12. FIGS. 7A and 7B show that the blocks 106 that engage the lower ends of the straight end members 28, 30 are adjacent to the distal ends 118 of the base support members 18, 20 when the rail portion 12 is in the stored position. FIGS. 7A and 7B show that the traversing member 32 of the U-shaped tubular frame 16 is adjacent to a straight line running between proximal ends 120 of the base members 18, 20. In other words, the length or height of the rail portion 12 is about equal to the length of the base portion 14. From FIGS. 7A and 7B it is easy to visualize that, once the junctions 72, 80, and 82 are disengaged, that one the left side unit of the rail portion 12 can be laid upon the right side unit of the rail portion 12 for storage or transport in a relatively flat parallelepiped cardboard box or in a fashion where one set of disengaged junction ends lie immediately inwardly of straight end member 28 and where the other set of disengaged junction ends lie immediately inwardly of straight end member 30. FIGS. 7A and 7B show that, in the stored position, the tubing of rail portion 12 lies either perpendicularly to base support members 18, 20 or parallel to base support members 18, 20, with the exception of transition tube portions 34, 36.

As shown in FIGS. 8A and 8B, straight end member 30 includes a pair of diametrically opposite vertically extending slots 122. Straight end member 28 also includes such slots 122. A pin 124 of each of the lower T-joints 54 rides vertically in slot 122. Each of the straight end members 28, 30 further includes a coil spring 126 housed within the straight end members 28, 30. Coil spring 126 is in the operating position shown in FIG. 8A compressed between punched in stops 128 and pin 124. Stops 128 are integral and one-piece with their respective straight end members 28, 30. Stops 128 are disposed diametrically opposite of each other. Coil spring 126 is also compressed when the sub-unit 38 is lifted out of the seat apparatus 88, as shown in FIG. 8B. Coil spring 126 continually urges pin 124 toward the bottom end or distal end of slot 122 such that sub-unit 38 remains engaged in seat apparatus 88 unless a lifting force is applied to sub-unit 38. In the position shown in FIGS. 78 and 7B, and further in the positions shown in FIGS. 6B, 6C, and 6D, the pin 124 is in the bottom end or distal end as shown in FIG. 8A. Thus, the distance of travel of the sub-unit 38 on the straight end members 28, 30 is defined by the length of slot 124.

At all times coil spring 126 is compressed, whether the rail portion 12 is in the operating position shown in FIG. 1 or in the fully stored position shown in FIG. 7A.

As shown in FIGS. 7A and 7B, pin assembly 26 includes a pin head 130, a pin shaft 132, a T-shaped washer or bearing 134, and a lock nut 136. The T-shaped washer or bearing 134 rides in longitudinal slot 24 and further rides against the inside face of the inner wall of base support members 18 or 20. The washer or bearing 134 also extends into block 106. Pin assembly 26 engages block 106 to keep the block 106 engaged to the lower end of its respective straight end member 28 or 30. Block 106 spaces the lower end of the straight end members 28, 30 from its respective base support member 18, 20.

FIGS. 9, 10, 11, 12, 13, 14, 15, 16, 17, and 18 are views of a second embodiment, or portions of a second embodiment, of the present swing and slide bed rail. The second embodiment is a swing and slide bed rail 138 that is identical to bed rail 10 except that the traversing support member 32 is replaced with undulating traversing support member 140 (shown in FIG. 17) and except that traversing support member 140, transition portions 34, 36, and portions of the straight end members 28, 30 are covered with resilient tubing 142 such as foam tubing.

Figure 17:
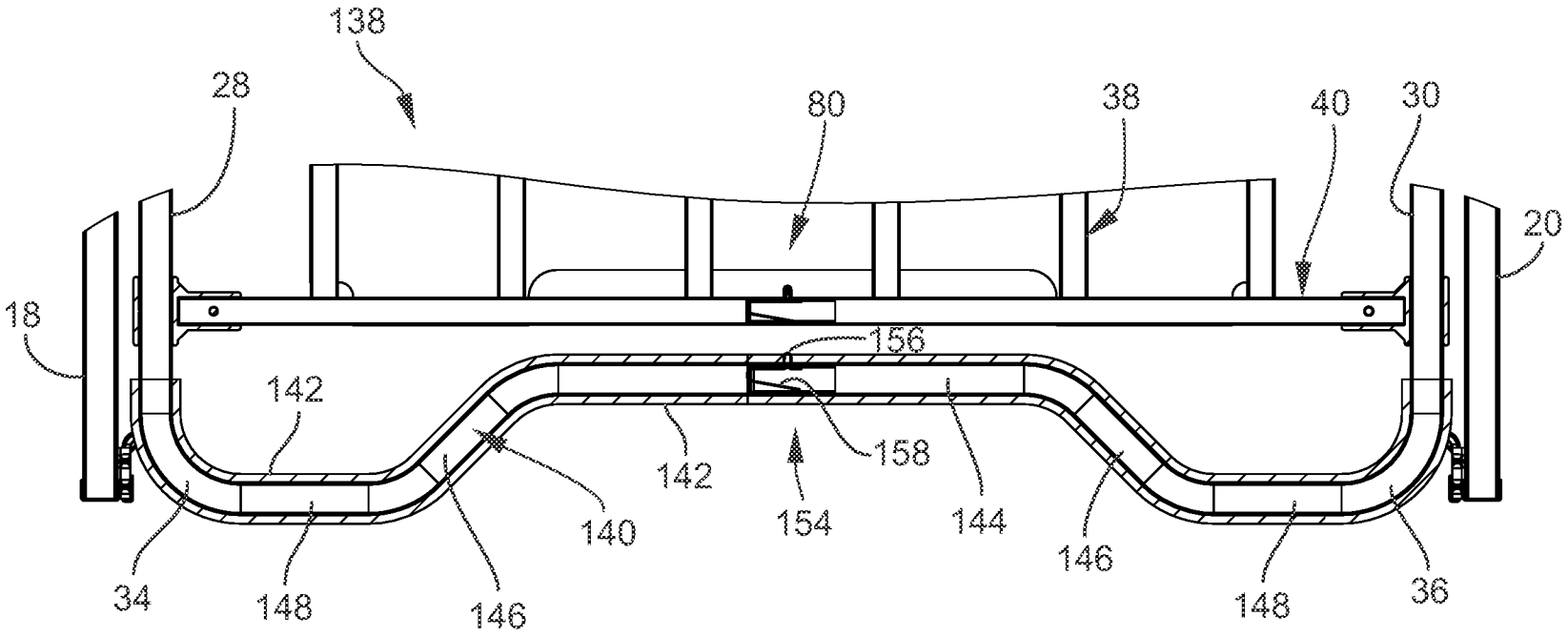
FIG. 17 is a section partial view of the swing and slide bed rail of FIG. 9.
Figure 18:
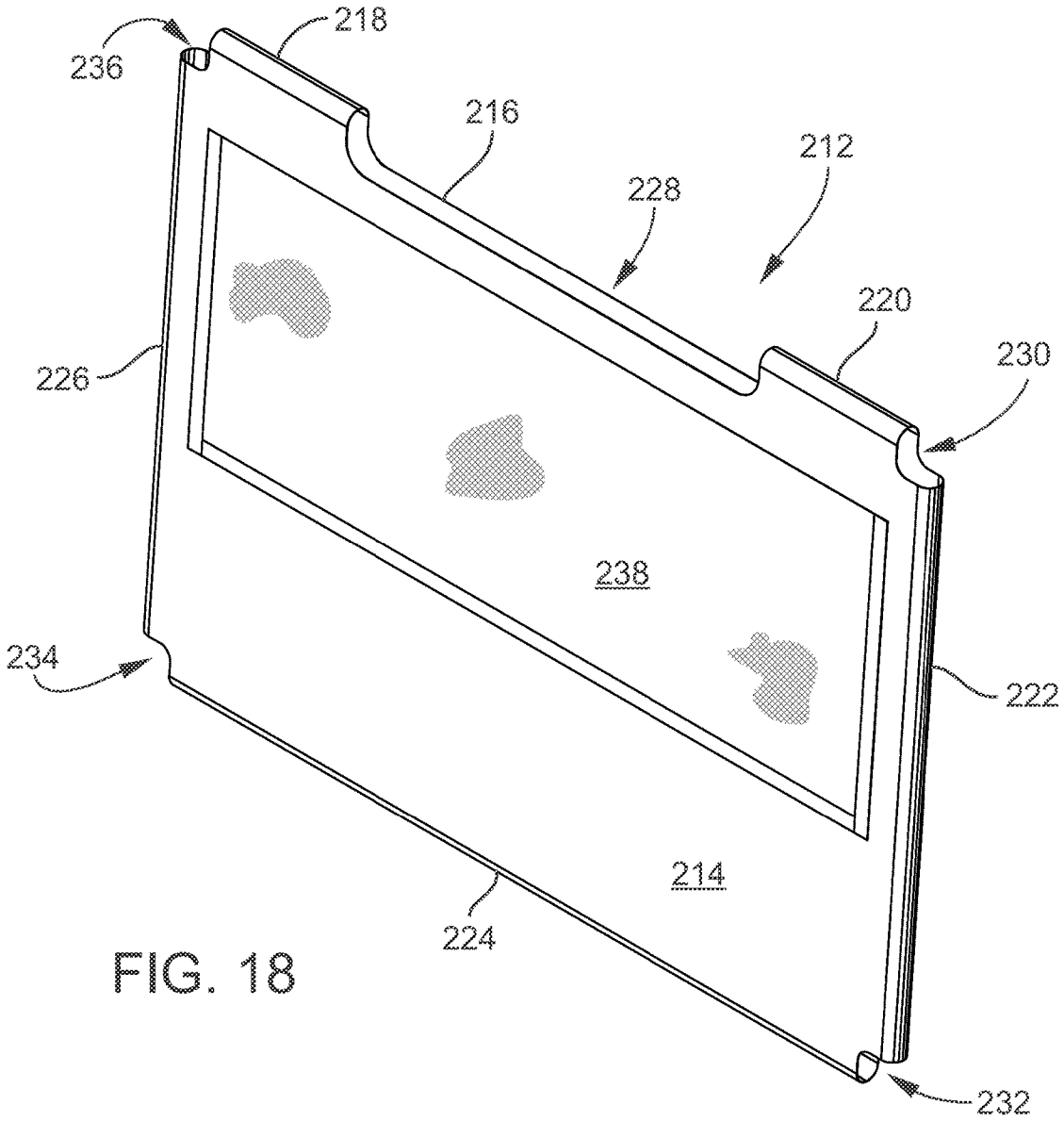
FIG. 18 is a perspective view of the sheeting of the swing and slide bed rail of FIG. 9.

FIG. 17 shows traversing member 140. Traversing member 140 is undulating so as to have a) a straight tubular portion 144 that is spaced from and runs adjacent to uppermost traversing member 40 of sub-unit 38, b) oblique tubular portions 146 that extend from the outer ends of straight tubular portion 144 and that are obliquely oriented relative to straight tubular portion 144, and c) straight tubular portions 148 that extend from the oblique tubular portions 146. One straight tubular portion 148 extends into transition tubular portion 34. The other straight tubular portion 148 extends into transition tubular portion 36. Each of the oblique portions 146 includes a first curved section, a straight section, and a second curved section. Each of the straight tubular sections 148 is spaced from uppermost traversing member 40 of sub-unit 38 at a greater distance than straight tubular portion 144 is spaced from uppermost traversing member 40 of sub-unit 38.

Resilient tubing 142 extends from the upper (or outer) end of straight end member 28 to transition tubular portion 34, to the adjacent straight tubular portion 148, to the adjacent oblique tubular portion 146, to straight tubular portion 144, to the other oblique tubular portion 146, to the other straight tubular portion 148, to transition portion 36, and finally to the upper (or outer) end of straight end member 30.

Uppermost traversing member 40 of sub-unit 38 includes an uppermost (or outermost) surface, which surface is adjacent to a lowermost (or innermost) surface of straight tubular portion 144. The distance between such surfaces, or such adjacent surfaces, is about equal to or slightly greater than the length of slot 122. At such a distance, when the bed rail 138 is in the operating position, a user may lay his or her fingers on the resilient tubing 142 about straight tubular portion 144 and raise the sub-unit 38 by gripping uppermost traversing member 40 of sub-unit 38 with his or her thumbs until the inserts 62, 64 disengage from their respective seats 98, 100, whereupon the rail portion 12 with traversing portion 140 may be pivoted downwardly and then slid into base portion 14.

Straight portion 144 includes a male portion 150 engagable with a female portion 152 such that, just like traversing member 32 of bed rail 10, traversing support member 140 includes a junction, with such junction carrying the reference number 154. Resilient tubing 142 is not continuous at this location but instead includes abutting portions that abut each other when junction 154 is engaged or closed. Member 140 includes a spring biased button 156. Button 156 is one-piece and integral with a U-shaped spring base 158, as shown in FIG. 17.

Uppermost traversing member 40 of bed rail 138 (and bed rail 10) includes a first section 160 with a male connecting member 162 and a second section 164 with a female connecting member 166 that, along with button 84 or button lock 84, make up junction 80.

Traversing member 42 of bed rail 138 (and bed rail 10) includes a first section 168 with a male connecting member 170 and a second section 172 with a female connecting member 166 that, along with button 86 or button lock 86, make up junction 82.

Distal ends 118 of base support members 18, 20 may be interconnected with a traversing support member 176. Traversing member 176 includes a first section 178 with a male connecting member 180 and a second section 182 with a female connecting member 184. Male and female members 180, 184 are engaged by a spring based button apparatus 186 that engages aligned button holes in the male and female connecting members 180, 184 so as to form a junction 183. Spring biased button apparatus 188 and 190 are also engaged at opposite ends of traversing support member 176. Button apparatus 188 engages male end 192 to a female connection 194 engaged to distal end 118 of base support member 18. Button apparatus 190 engages male end 196 to a female connection 198 engaged to distal end 118 of base support member 20.

An anchoring flexible strap apparatus 200 is engaged to each of the distal ends 118 of each of the base members 18, 20. Strap apparatus 200 includes a base strap 202 extending from distal end 118. Then, upper and lower straps 204, 206 are engaged to the base strap 202. Then, a female buckle portion 208 is engaged to the distal end of upper strap 204 and a male buckle portion 210 is engaged to the distal end of lower strap 206. Female buckle portion 208 and male buckle portion 210 are engagable to each other after being wrapped around a metal support structure on the far side of the mattress 15 and mattress support 17.

Figure 10:
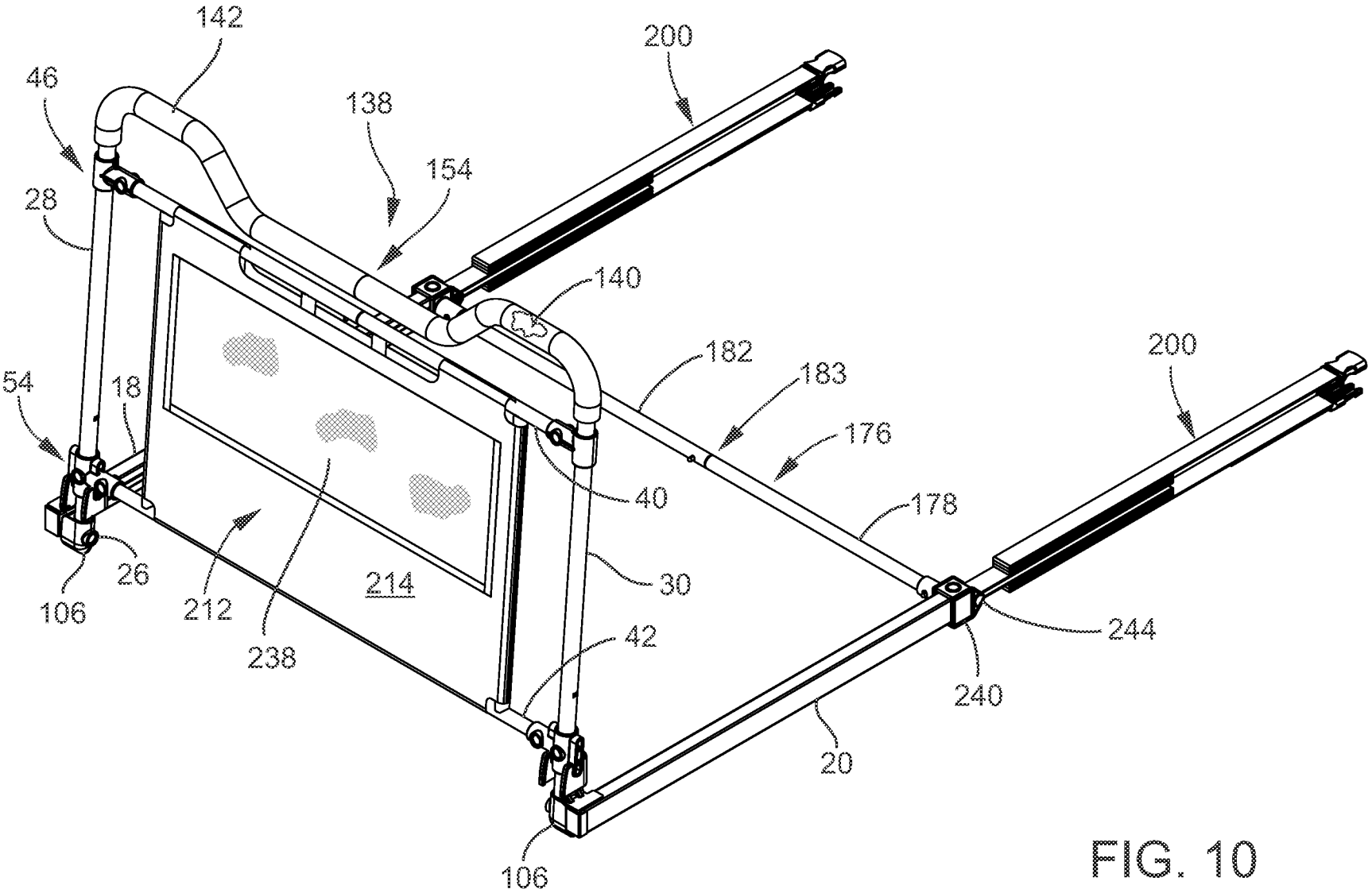
FIG. 10 is an assembled perspective view of the swing and slide bed rail of FIG. 9.
Figure 11:
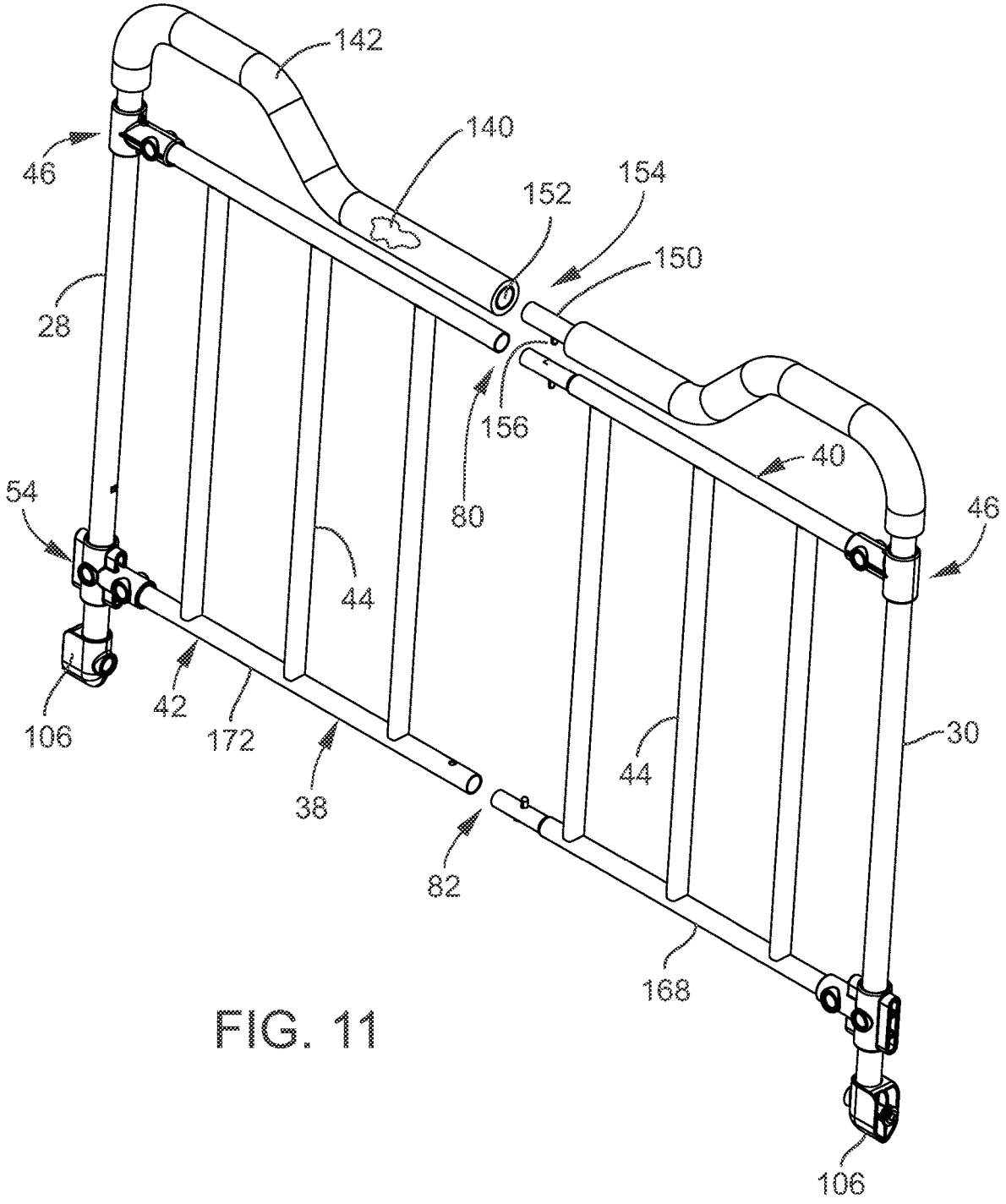
FIG. 11 is a perspective view of the rail portion of the swing and slide bed rail of FIG. 9.
Figure 12:
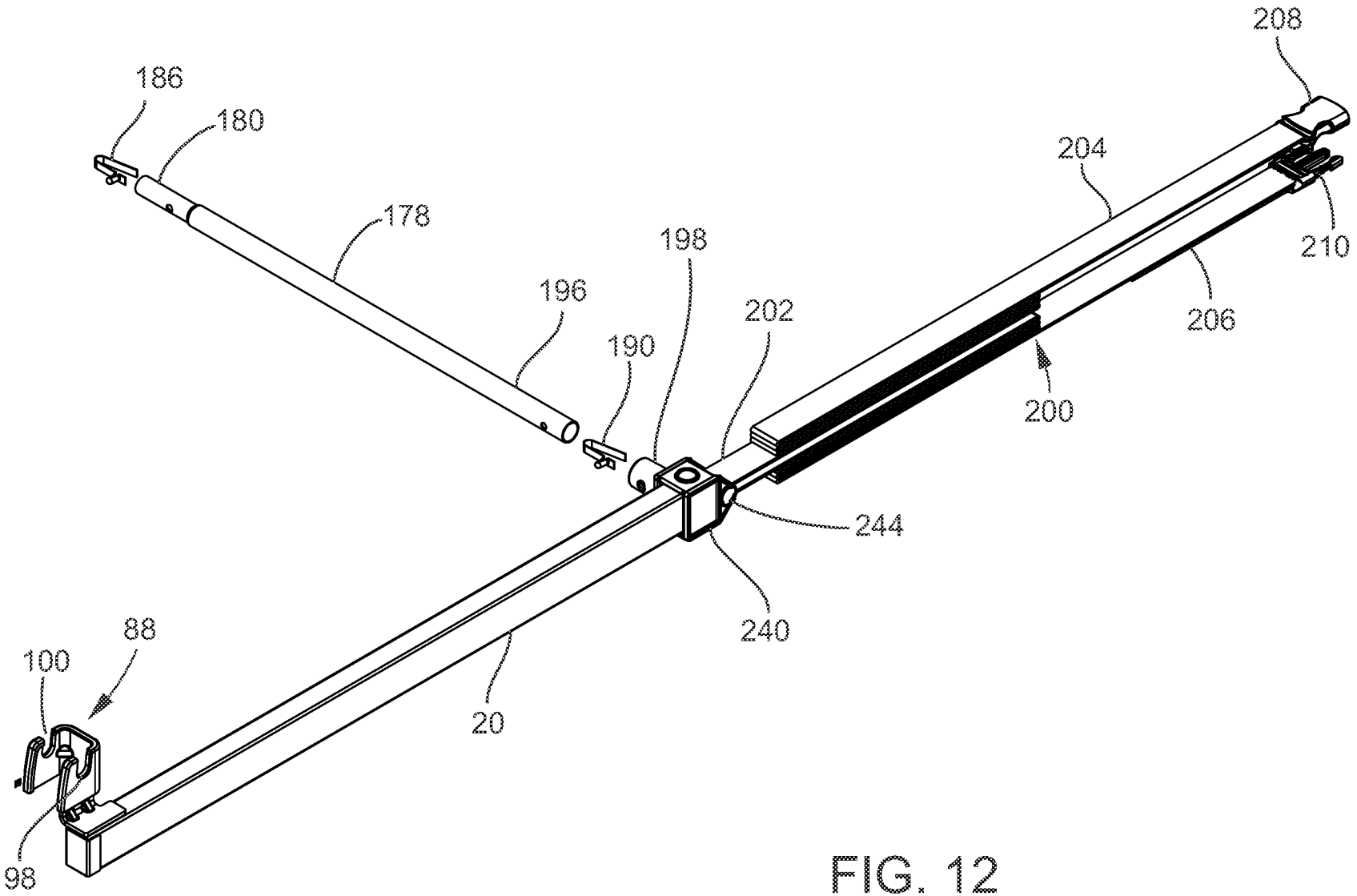
FIG. 12 is a perspective view of a first base portion of the swing and slide bed rail of FIG. 9.

Sheeting 212 engages the sub-unit 38 of either bed rail 138 or bed rail 10. As shown in FIG. 9, sheeting 212 includes a front side 214 and a rear side 216. Front side 214 is spaced apart from rear side 216. Sheeting 212 includes portions that connect the front side 214 to the rear side 216. These connecting portions are portions 218, 220, 222, 224, and 226. Where connecting portions are absent, openings are present. These openings are openings 216, 230, 232, 234, and 236. As shown in FIG. 10, connecting portion 218 engages section 164. Opening 228, between connecting portions 218 and 220, permits access to junction 80 and button 84. Opening 228 further permits direct access to uppermost traversing member 40 that is grasped by hand to raise the sub-unit 38. The length of opening 228 is about the length of straight portion 144, where portion 144 is the portion of member 140 that is the closest to uppermost traversing member 40. The palm of the hand may be placed on the resilient tubing 142 about straight portion 144 and the fingers and/or thumb may be used to raise the sub-unit 38 to disengage the inserts 62 and 64 from their respective seats 98, 100. Connecting portion 220 engages section 160 of uppermost traversing member 40. Opening 230, between connecting portion 220 and connecting portion 222, permits passage of uppermost traversing member 40 to the upper T-joint 46 of straight end member 30. Connecting portion 222 engages the right side outermost vertical support member 44 of sub-unit 38. Opening 232, between connecting portions 222 and 224, allows passage of the lowermost traversing member 42 to the lower T-joint 54 of straight end member 30. Connecting portion 224 engages lowermost traversing member 42. Opening 234, between connection portions 224 and 226, allows passage of the lowermost traversing member 42 to the lower T-joint 54 of straight end member 28. Connecting portion 226 engages the left side outermost vertical support member 44 of sub-unit 38. Opening 236, between connecting portions 226 and 218, permits passage of the uppermost traversing member 40 to the upper T-joint 46 of straight end member 28. To engage sheeting 212 with sub-unit 38, zippers that are disposed along the entire lengths of connecting portions 222, 224, and 226 may be opened, which zippers are closed after the front side 214 of the sheeting 212 is disposed over the front side of the sub-unit 38 and after the rear side 216 of the sheeting 212 is disposed over the rear side of the sub-unit 38. Each of the front and rear sides 214, 216 of sheeting 212 may include a rectangular mesh portion 238. Each of the rectangular mesh portions 238 is see through and the combination of the rectangular mesh portions 238 is see through such that a person on the mattress can see through the rectangular mesh portions 238, to see, for example, a visitor.

Figure 13:
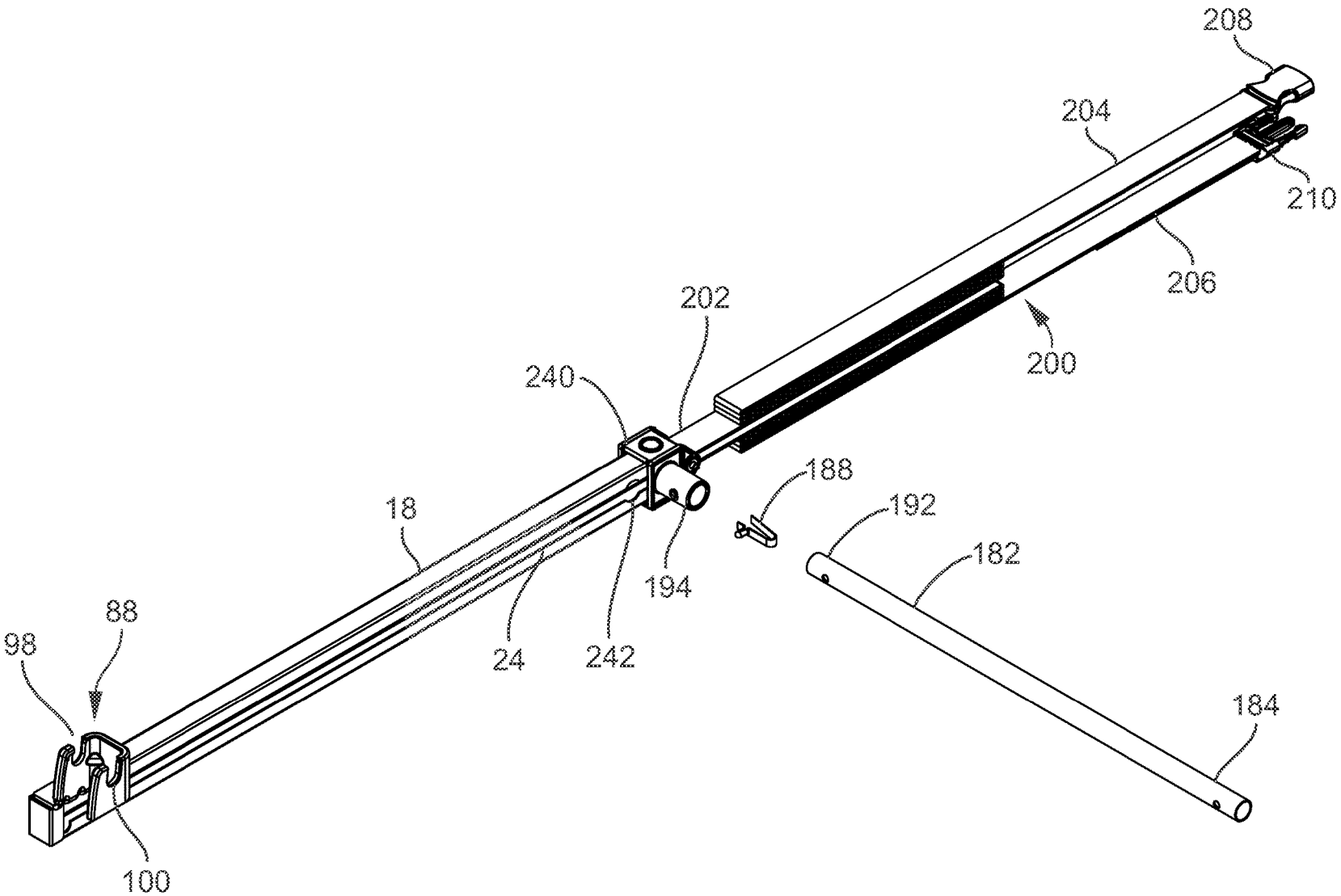
FIG. 13 is a perspective view of a second base portion of the swing and slide bed rail of FIG. 9.
Figure 14:
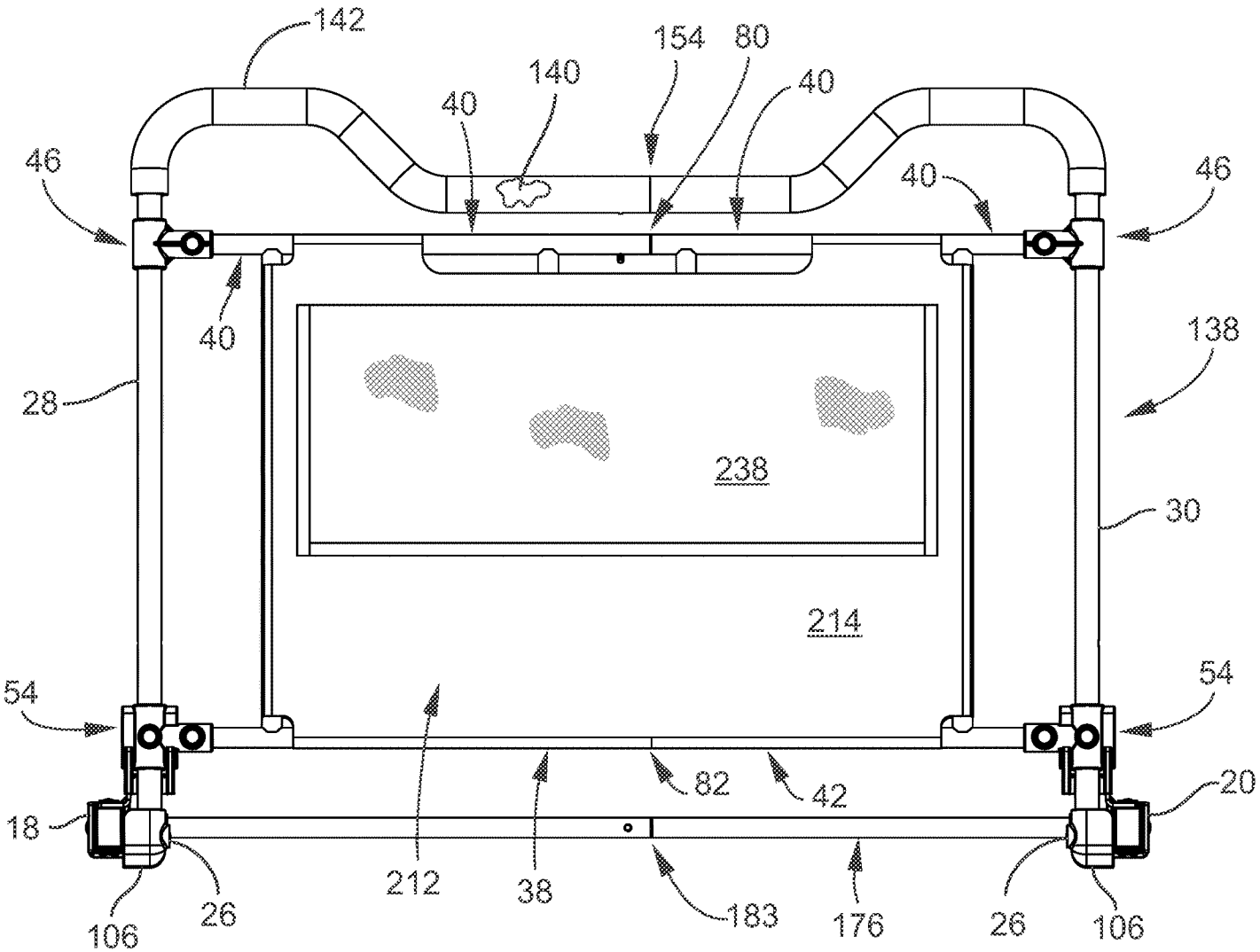
FIG. 14 is a front elevation view of the swing and slide bed rail of FIG. 9 in the locked and operating position of FIG. 10.
Figure 15:
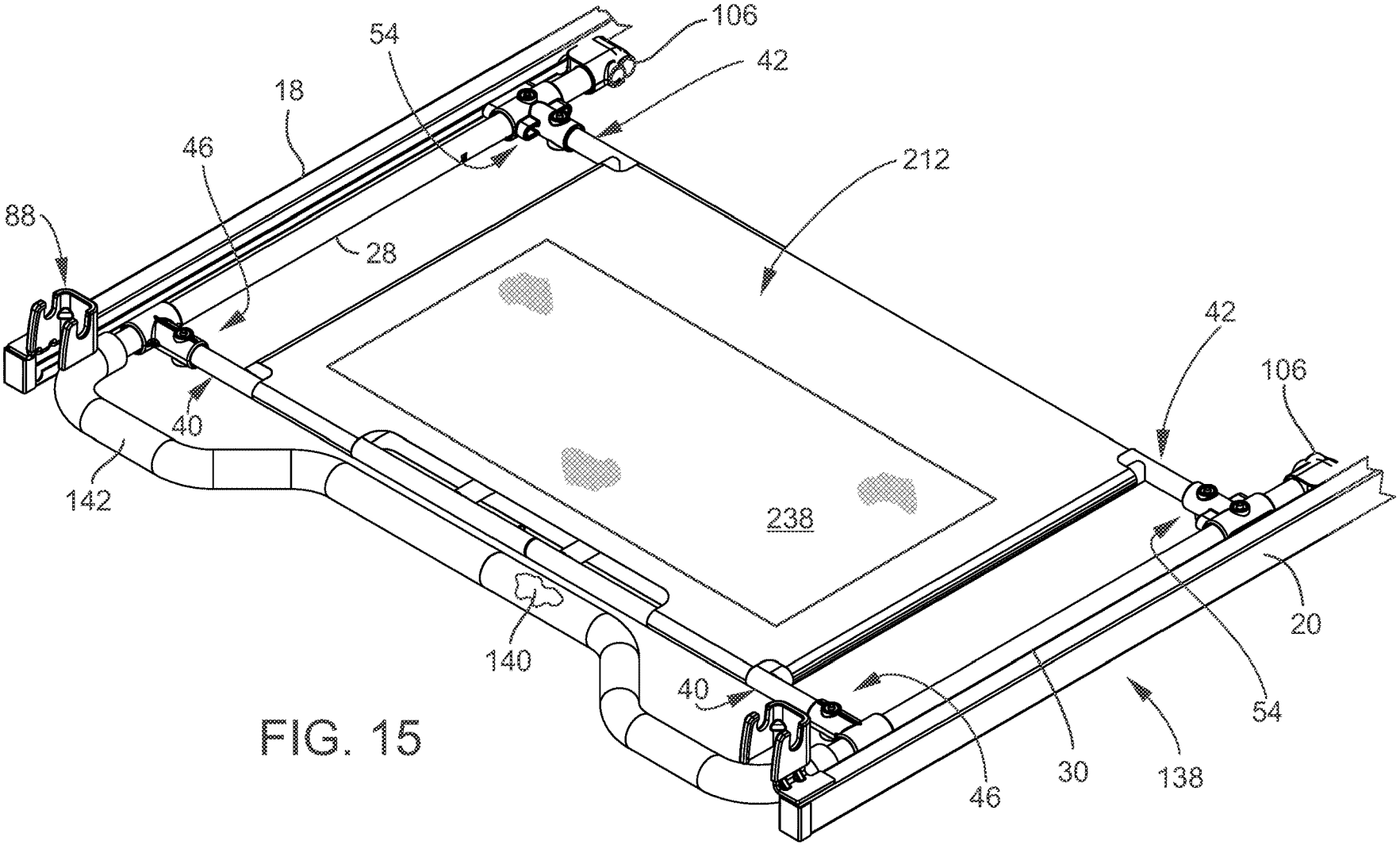
FIG. 15 is a top perspective view of the swing and slide bed rail of FIG. 9 in a compact planar form for storage between a mattress and mattress support.
Figure 16:
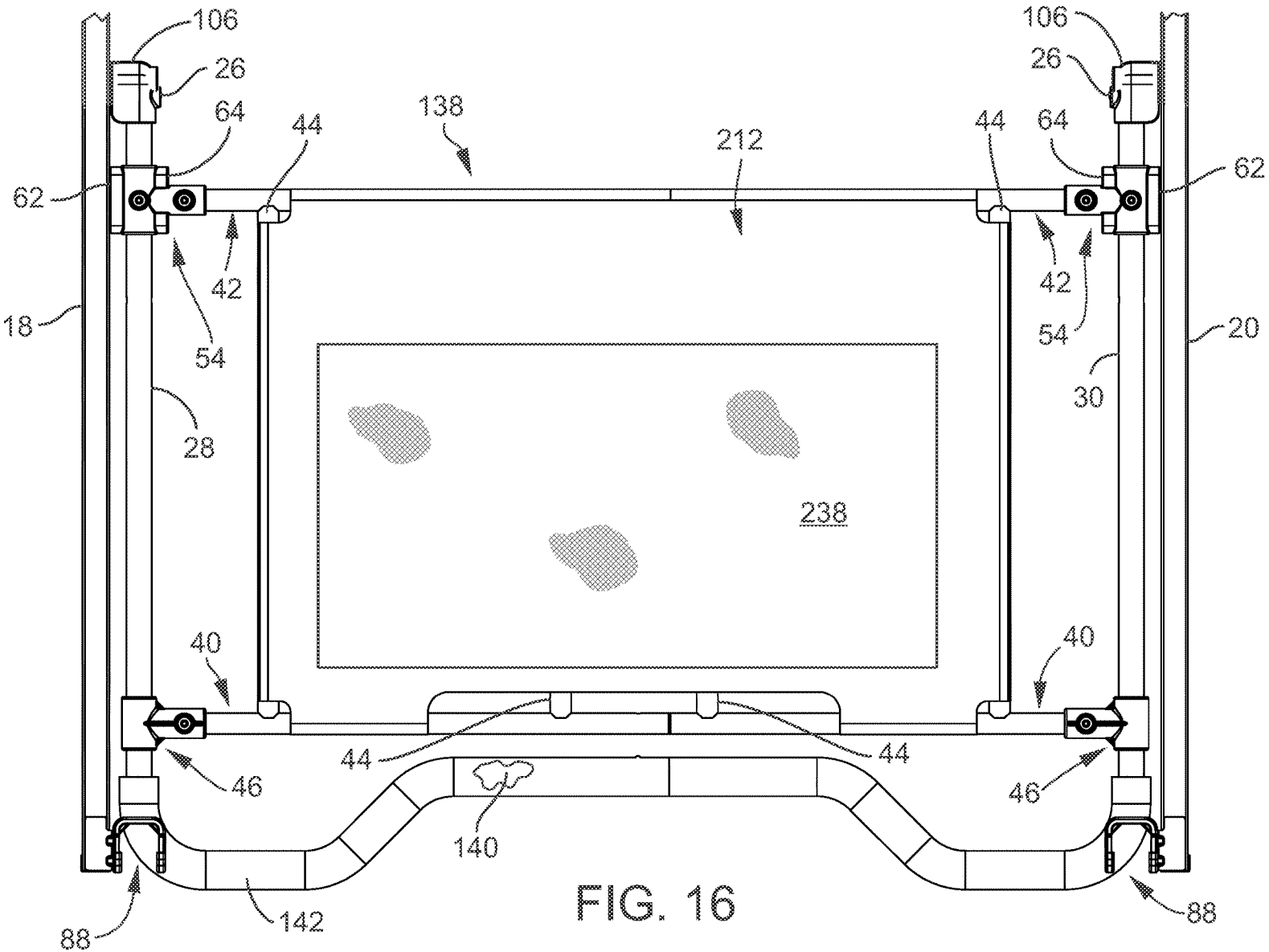
FIG. 16 is a top plan view of the swing and slide bed rail of FIG. 9 in the compact planar form of FIG. 15.

In operation, to take the rail portion 12 from an operating position to a stored position, reference may be made to FIG. 5A where the rail portion 12 is in the operating position, which positon would be confronting the near side of a mattress 15 and mattress support 17. In this position, inserts 62 and 64 of each of the lower T-joints 54 are seated or locked in their respective seats 98, 100. This position is also shown in FIG. 8A where the coil spring 126 urges pin 124 to the bottom of slot 122. Since pin 124 is part of lower T-joint 54, which is part of the sub-unit 38, the sub-unit 38 is in a down position. In this down position, uppermost traversing member 40 is relatively spaced apart from traversing member 32 of the U-shaped tubular frame 16. To begin the process of swinging down the rail portion 12, the uppermost traversing member 40 is lifted up, which lifts the sub-unit 38 as a whole up, and which causes upper and lower T-joints 46 and 54 to slide upwardly on the straight end members 28, 30 of the U-shaped support member 16, and which action compresses the coil spring 126. As the lower T-joints 54 slide upwardly, the inserts 62 and 64 become disengaged from their respective seats 98, 100, whereupon the rail portion 12, i.e., the sub-unit 38 and the U-shaped tubular frame 16, may swing forwardly and pivot about pin assembly 26. As the swinging begins, the uppermost traversing member 40 may be released relative to traversing member 32, whereupon the upper and lower T-joints 46, 54 begin to slide, under the expansion of coil spring 126, in the direction away from traversing member 32. This sliding stops when pin 124 hits the bottom of slot 122. Inserts 62, 64 do not return to their respective seats 98, 100 because the lower T-joints 54 and their inserts 62, 64 have been rotated forwardly with the swinging of the rail portion 12. When the rail portion 12 reaches a plane defined by base support members 18, 20, or prior to such a time, the rail portion 12 may begin to be pushed with a sliding motion into base portion 14 and between the base support members 18, 20, whereupon the pin assembly 26 begins to slide in the longitudinal slot 24. Rail portion 12 may be slid entirely into the base portion 14 until the uppermost or outermost portion of traversing member 32 is aligned with or within the proximal ends of base support members 18, 20. In this fully compact or fully stored position, blocks 106 are adjacent to the distal ends of base support members 18, 20 and adjacent to end cap assemblies 240 and adjacent to traversing member 176. Female connections 198 may work as stops for the blocks 106. Further, pin assembly 26 may be seated in a distal seat 242 that communicates with longitudinal slot 24. Distal seat 242 is shown in FIG. 13.

In operation, to take the rail portion 12 from a stored position to an operating position, reference may be made to FIGS. 6D, 7A, 7B, and 7C. The first step is grasping the traversing member 32 of the U-shaped tubular frame 16 and pulling the rail portion 12 away from the distal ends 118 of the base support members 18, 20 such that pin assembly 26 is pulled out of distal seat 242 and slides away from the distal end 118 in longitudinal slot 24. Then, as the pin assemblies 26 slide the length of the base support members 18, 20 and approach the proximal ends of base support members 18, 20, the user may begin to pivot the rail portion 12 upwardly about the pin assemblies 26. As the rail portion 12 is swung or rotated upwardly, the rear sides of inserts 62, 64 hit and slide against the front edges of walls 92, 94, which front edges taper inwardly and rearwardly so as to urge the inserts 62, 64 upwardly, which urges the lower T-joints 54 upwardly and the sub-unit 38 as a whole upwardly, which compresses springs 126, until the bottoms of the inserts 62, 64 slide over the top edges of walls 92, 95, whereupon the inserts 62, 64 snappingly lock into their respective seats 98, 100 with the uncoiling and extension of the coil springs 126. Such lifting of the sub-unit 38 may be aided by the user lifting the sub-unit 38 himself or herself relative to the U-shaped tubular frame 16 and its traversing member 32.

Operation of the bed rail 138 is identical to operation of bed rail 10. With bed rail 138, undulating traversing member 140 permits the user to squeeze together with one hand the traversing member 40 of sub-unit 38 and undulating traversing member 140 so as to draw the inserts 62, 64 out of their respective seats 98, 100. As such, unlocking of the rail portion 12 of bed rail 138, swinging down the rail portion 12 of bed rail 138, and sliding the rail portion 12 of the bed rail 138 into the base 14 is a one handed operation.

As shown in FIG. 5A, straight end member portion 30 may compress a corner of the mattress 15, where such corner is the general intersection of the near side of the mattress 15 and the sleeping surface of the mattress 15. This compression closes off any gaps that may otherwise form between the near side of the mattress 15 and the rail portion 12. Straight end member portion 30 defines a plane with the six vertical support member portions 44 and straight end member 28 such that these six vertical support member 44 and straight end member 28 also compressively engage such general intersection of the near side of the mattress 15 and the sleeping surface of the mattress 15. The acute angular relationship of the axis of such plane relative to base member portions 18, 20 provide an unimpeded sliding of the lower T-joints 54, which T-joint 54 slides the length of slot 122, which length is relatively small. It should also be noted that there is unimpeded sliding of upper T-joints 46 since such are disposed above the mattress 15. The outside cylindrical surfaces of tubes 44 or vertical support member portions 44 are smooth and such slide easily against such general intersection, which intersection is likely covered by relatively slippery sheets or blanket or other textile or synthetic covering. Tubes or vertical support members 44 slide when the sub-unit 38 and its inserts 62, 64 are being unlocked or unseated from their respective seats 98, 100.

It should be noted that U-shaped tubular frame 16 including traversing member 32 and straight end members 28, 30, undulating traversing member 140, uppermost and lowermost traversing members 40, 42, and vertical support members 44 are tubes and are preferably metal tubes. The metal of such tubes may be aluminum or steel or some other metal or alloy.

Figure 19:
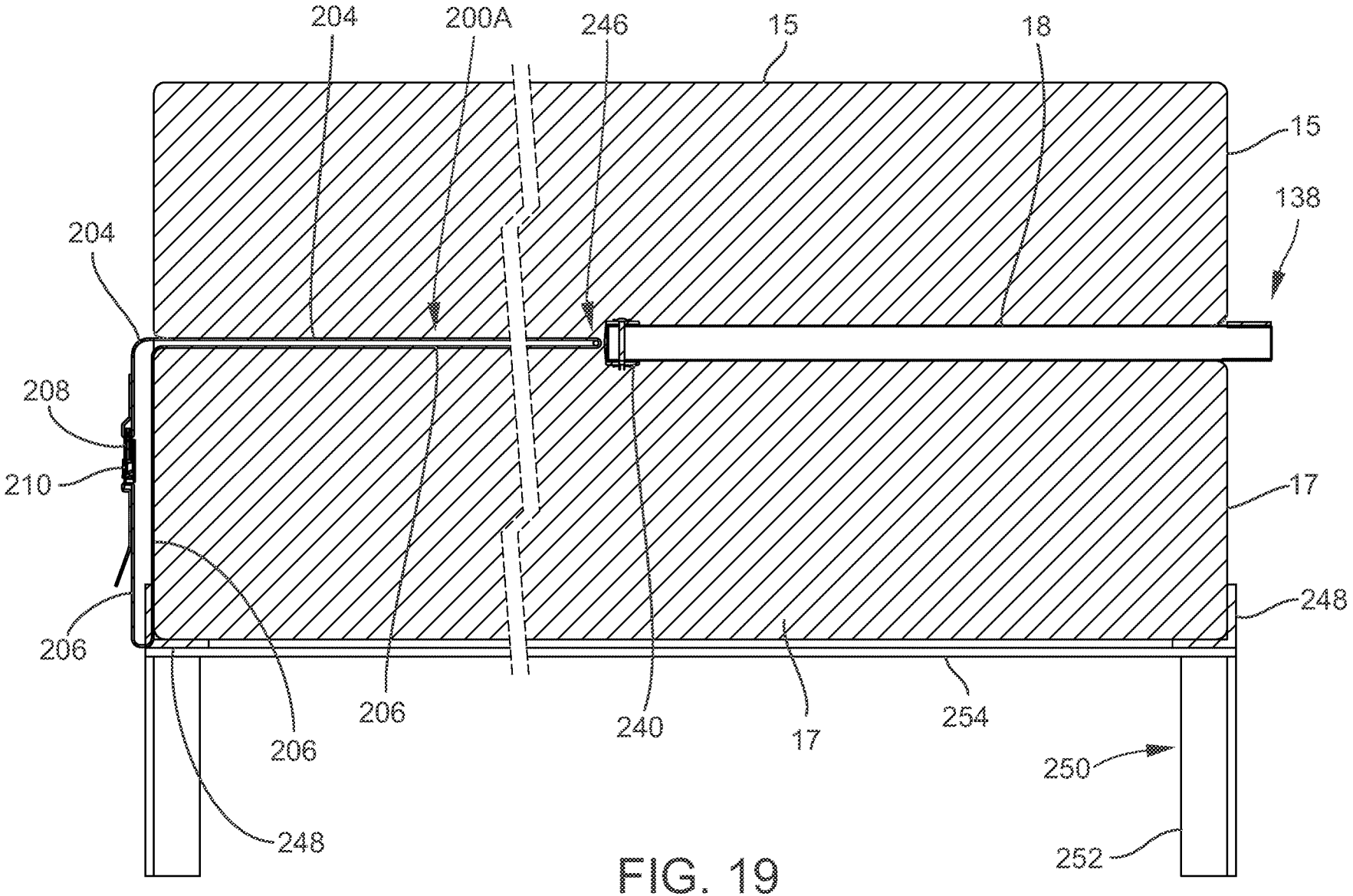
FIG. 19 is a section, diagrammatic, and broken apart view of the bed rail of FIG. 9 sandwiched between a mattress and mattress support of a bed and engaged to the far side of the bed, and shows the strap apparatus used to engage the bed rail to the far side of the bed.
Figure 20:
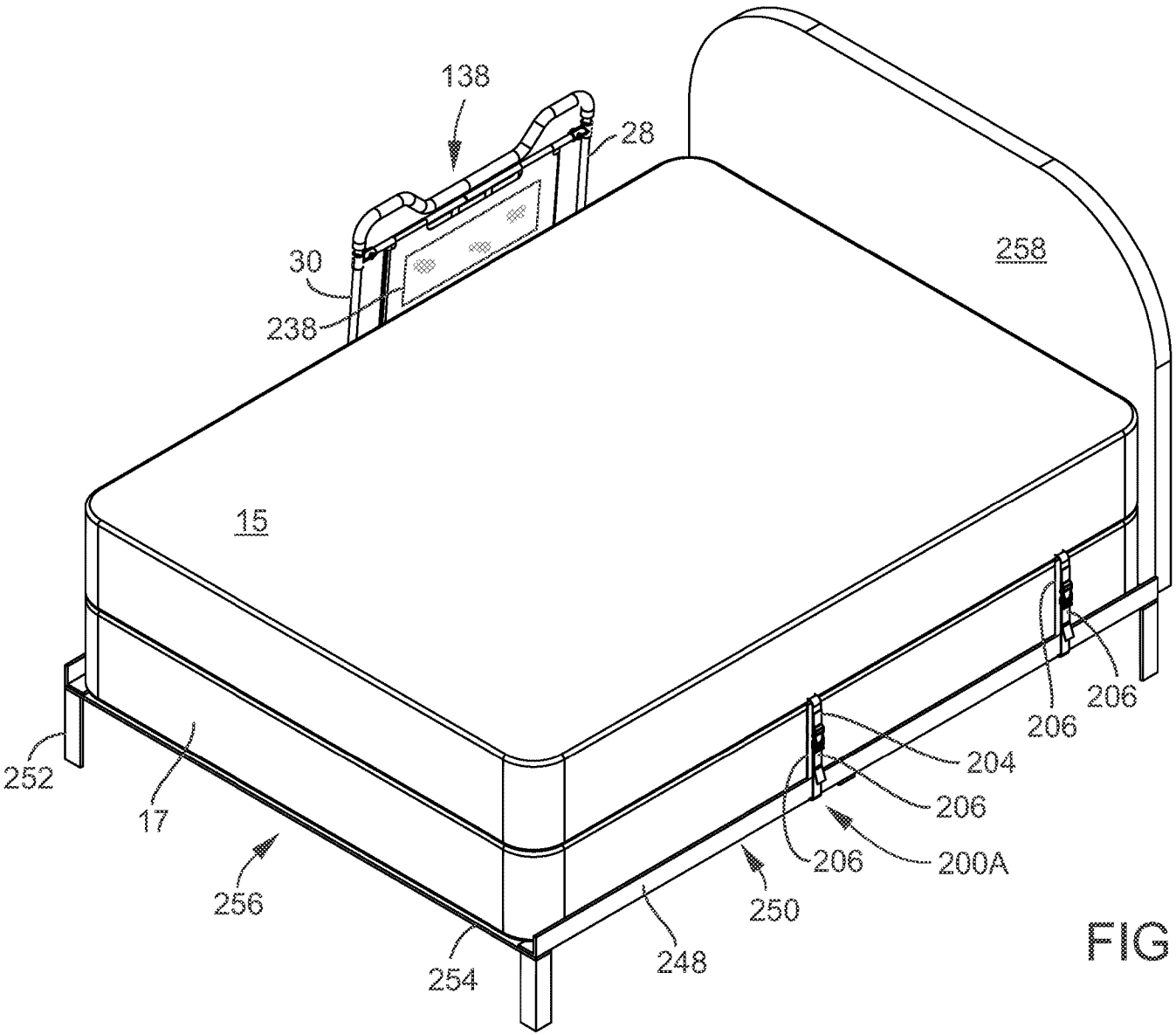
FIG. 20 is a perspective view of the bed rail of FIG. 9 engaged to the bed of FIG. 19 and shows the strap apparatus of FIG. 19 engaged to the far side of the bed.
Figure 21:
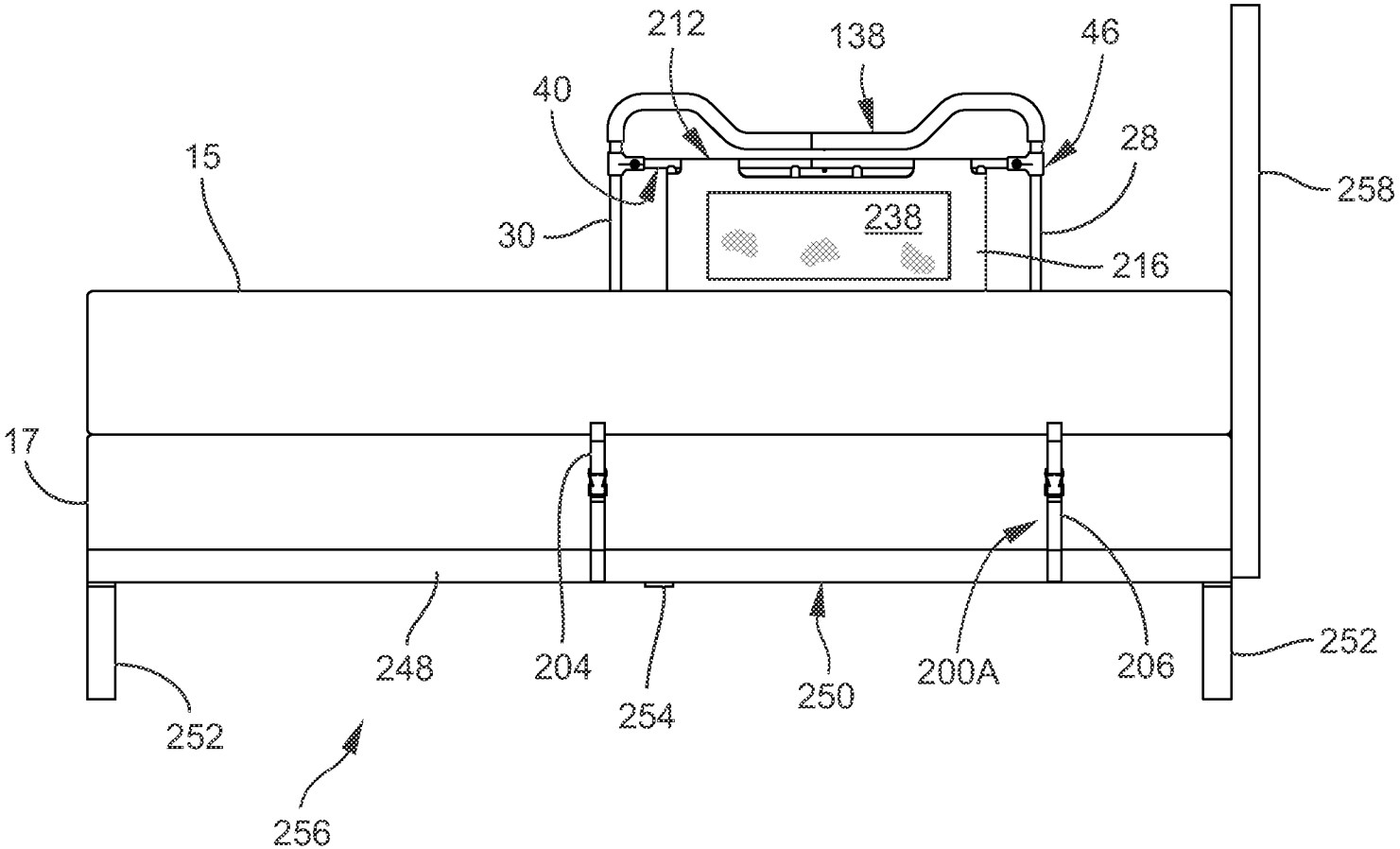
FIG. 21 is an elevation view of the bed rail of FIG. 9 engaged to the bed of FIG. 19 and shows the strap apparatus of FIG. 19 engaged to the far side of the bed.

FIGS. 19-21 show a strap apparatus 200A engaged to bed rail 138. FIG. 19 shows bed rail 138 in the stored position between the mattress 15 and mattress support 17. Strap apparatus 200A extends from a strap mount 244 shown in FIG. 12. Strap mount 244 is engaged to and extends rearwardly from end cap assembly 240. Strap mount 244 may include a pair of triangular extensions extending longitudinally and rearwardly, with a post 246 extending laterally between rearward most apexes of the triangular extensions. Post 246 is shown in FIG. 19. Whereas FIGS. 9, 10, 12, and 13 show a strap apparatus 200 having base strap 202, FIG. 19 shows the strap apparatus 200A having eliminated base strap 202 and instead having straps 204 and 206 lead integrally into each other such that straps 204 and 206 are in effect a single strap from buckle 208 to winding about and engaging post 246 to buckle 210. Strap 206 engages a slot in an angle iron 248. Angle iron 248 supports the mattress support 17 as part of a metal bed frame 250. Metal bed frame 250 includes vertically extending legs 252, longitudinally extending angle irons 248, and lateral or cross supports 254. It should be noted that, instead of passing through a slot in angle iron 248, strap 206 may be wrapped about longitudinal support or angle iron 248.

As shown in FIGS. 20 and 21, a bed 256 includes the mattress 15, the mattress support 17, the bed frame 250, the legs 252, the lateral or cross supports 254, the longitudinal supports or angle irons 248, and a head board 258. Strap apparatus 200A includes straps 204, 206 that form a loop from the distal end cap assembly 240 to the far side angle iron 248 to secure the base portion 14 of the bed rail 10 or bed rail 138. Connecting wall 96 of the seat apparatus 88 acts as a counter member on the near side of the bed 256, namely, pressing relatively against the near side of the mattress 15, while the far end of the loop about the far angle iron 48 acts as the opposing counter member. Such opposing pressure secures the base portion 14 at one location whether the bed rail 10 or 138 is in the stowed and tucked away position or in the operating position confronting the near side of the bed and extending above the sleeping surface of the mattress 15. Theoretically, tightening strap apparatus 200 or 200A to an upmost degree pulls the mattress 15 such that the near side of the mattress 15 is pulled over to the far side of the mattress support 17. However, in practice, the portable bed rail 10 or 138 is relatively light (has relatively little mass) and the mattress 15 has relatively great mass such that the weight of the mattress 15 does not let the user tighten the strap apparatus 200 or 200A to such a theoretical degree and such that the bed rail 10 or 138 is well anchored by the opposing counter members whether the bed rail 10 or 138 is in the operating position or slid fully into the stowed position.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalents of the claims are intended to be embraced therein.

What is claimed is:

1. A bed rail for engagement to a bed having a mattress and mattress support, the mattress having a near side, the bed rail comprising:

a) a rail portion;

b) a base portion engaged to the rail portion and adaptable for engagement with the bed between the mattress and mattress support, the base portion having first and second base members spaced apart from each other;

c) the rail portion having a first position and a second position, the first position being an operating position adjacent to the near side of the mattress, the second position being a stored position in the base portion between the mattress and the mattress support;

d) the rail portion comprising an outer frame and an inner frame;

e) the outer frame of the rail portion comprising a traversing member and first and second end members, the traversing member extending between and engaged to the first and second end members;

f) the inner frame being slideable on the first and second end members of the outer frame and slideable to and away from the traversing member of the outer frame;

g) the inner frame being engagable with and disengagable from the first and second base members of the base portion to prevent the rail portion from sliding relative to the base portion;

h) wherein the inner frame includes an uppermost traversing member, the uppermost traversing member of the inner frame being slideably engaged to the first and second end members of the outer frame, the uppermost traversing member of the inner frame being slideable to and away from the traversing member of the outer frame; and i) wherein the inner frame includes a lowermost traversing member, the lowermost traversing member of the inner frame being slideably engaged to the first and second end members of the outer frame, the lowermost traversing member of the inner frame being slideable to and away from the first and second base members when the rail portion is in the operating position;

j) wherein the traversing member of the outer frame is undulating and wherein the first and second end members are straight end members having respective first and second distal ends;

k) the traversing member of the outer frame having a first portion, a second portion, and a third portion, the first and third portions of the traversing member of the outer frame being spaced apart from the uppermost traversing member of the inner frame by a first distance, the third portion of the traversing member of the outer frame being spaced apart from the uppermost traversing member of the inner frame by a second distance, and the first distance being greater than the second distance;

l) wherein the first portion includes a first straight portion having an axis, wherein the second portion includes a second straight portion having an axis, and wherein the third portion includes a third straight portion having an axis, wherein the axis of the first and third straight portions of the outer frame are co-axial, and wherein the axis of the second straight portion is offset from the axis of the first and third straight portions; and m) wherein the traversing member of the outer frame further comprises fourth and fifth straight portions, the fourth straight portion being disposed between the first and second straight portions, the fifth straight portion being disposed between the second and third straight portions, each of the fourth and fifth straight portions being oblique relative to the second straight portion.

2. The bed rail of claim 1, and a set of support members extending to and between the uppermost and lowermost traversing members, the support members being spaced apart from each other and further being spaced from the first and second end members of the outer frame, the uppermost traversing member of the inner frame being adjacent to the traversing member of the outer frame, the lowermost traversing member of the inner frame having first and second ends, the first end of the lowermost traversing member of the inner frame being adjacent to the first end member of the outer frame, the second end of the lowermost traversing member of the inner frame being adjacent to the second end member of the outer frame.

3. The bed rail of claim 1, and a set of support members extending to and between the uppermost and lowermost traversing member, the support members being spaced apart from each other and further being spaced from the first and second end members of the outer frame, the uppermost traversing member of the inner frame comprising first and second sections that are engagable to and disengagable from each other at a first junction that is disposed intermediate of ends of the uppermost traversing member of the inner frame, the lowermost traversing member of the inner frame comprising first and second sections that are engagable to and disengagable from each other at a second junction that is disposed intermediate of ends of the lowermost traversing member of the inner frame.

4. The bed rail of claim 3, wherein the traversing member of the outer frame includes a first frame section and a second frame section, the first and second frame sections being engagable to and disengagable from each other at a third junction that is disposed intermediate of ends of the traversing member of the outer frame such that the rail portion includes a right hand unit and a left hand unit that are engagable to and disengagable from each other.

5. The bed rail of claim 4, wherein the first, second, and third junctions are aligned vertically with each other when the rail portion is in the operating position.

6. The bed rail of claim 4, wherein the first, second, and third junctions are spaced equidistance from the first and second end portions of the outer frame member.

* * * * *